US010323217B2

(12) United States Patent
Gori et al.

(10) Patent No.: US 10,323,217 B2
(45) Date of Patent: Jun. 18, 2019

(54) DETERGENT COMPOSITION COMPRISING ENZYMES AND WASHING METHOD FOR PREVENTING ADHESION OF BACTERIA

(71) Applicant: Novozymes A/S, Bagsvaerd (DK)

(72) Inventors: Klaus Gori, Copenhagen (DK); Lilian Eva Tang Baltsen, Bagsvaerd (DK); Marie Allesen-Holm, Hilleroed (DK)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 14/647,186

(22) PCT Filed: Dec. 9, 2013

(86) PCT No.: PCT/EP2013/075922

§ 371 (c)(1),
(2) Date: May 26, 2015

(87) PCT Pub. No.: WO2014/087011

PCT Pub. Date: Jun. 12, 2014

(65) Prior Publication Data

US 2015/0299623 A1 Oct. 22, 2015

Related U.S. Application Data

(60) Provisional application No. 61/735,121, filed on Dec. 10, 2012.

(30) Foreign Application Priority Data

Dec. 7, 2012 (EP) ..... 12196059

(51) Int. Cl.

| | |
|---|---|
| ***C11D 3/386*** | (2006.01) |
| ***C11D 11/00*** | (2006.01) |
| ***C11D 3/48*** | (2006.01) |
| ***C11D 3/00*** | (2006.01) |

(52) U.S. Cl.

CPC ..... *C11D 3/38636* (2013.01); *C11D 3/0068* (2013.01); *C11D 3/386* (2013.01); *C11D 3/38618* (2013.01); *C11D 3/38645* (2013.01); *C11D 3/38654* (2013.01); *C11D 3/48* (2013.01); *C11D 11/0017* (2013.01)

(58) Field of Classification Search

CPC ..... C11D 3/38636; C11D 11/0017; C11D 3/38654; C11D 3/38645; C11D 3/38618; C11D 3/386; C11D 3/48; C12N 9/50; C12N 9/22

USPC ..... 435/199, 219

See application file for complete search history.

(56) References Cited

U.S. PATENT DOCUMENTS

| | | | | |
|---|---|---|---|---|
| 4,259,446 | A * | 3/1981 | Ando | C12R 1/125 435/199 |
| 5,558,812 | A | 9/1996 | Hahn et al. | |
| 2007/0191248 | A1* | 8/2007 | Souter | C11D 3/38627 510/320 |
| 2008/0293607 | A1* | 11/2008 | Jones | C11D 3/38609 510/226 |
| 2010/0047790 | A1* | 2/2010 | Southern | B01L 3/0293 435/6.11 |
| 2012/0045817 | A1 | 2/2012 | Estell | |

FOREIGN PATENT DOCUMENTS

| | | | |
|---|---|---|---|
| DE | 10304331 | A1 | 12/2004 |
| EP | 0 511 456 | A1 | 11/1992 |
| JP | 62-269686 | A | 11/1987 |
| JP | 2004-231671 | A | 8/2004 |
| JP | 2010-013418 | | 1/2010 |
| WO | 2006/031554 | A2 | 3/2006 |
| WO | 2007.087319 | A2 | 8/2007 |
| WO | 2008/112459 | A2 | 9/2008 |
| WO | 2011/098579 | A1 | 8/2011 |

OTHER PUBLICATIONS

Munk et al., Journal of Surfactants and Detergents, vol. 4, No. 4, pp. 385-394 (2001).
Tetz et al., Antimicrobial Agents and Chemotherapy, vol. 53, No. 3, pp. 1204-1209 (2009).
Whitchurch et al., Science, vol. 295, No. 5559, p. 1487 (2002).

* cited by examiner

*Primary Examiner* — Paul C Martin

(57) ABSTRACT

The disclosure concerns a detergent composition comprising one or more anionic surfactants; an enzyme selected from the group consisting of: a protease, a lipase, a cutinase, an amylase, a carbohydrase, a cellulase, a pectinase, a mannanase, an arabinase, a galactanase, a xylanase, and an oxidase; and a deoxyribonuclease (DNase), as well as methods for washing a textile.

11 Claims, No Drawings

Specification includes a Sequence Listing.

DETERGENT COMPOSITION COMPRISING ENZYMES AND WASHING METHOD FOR PREVENTING ADHESION OF BACTERIA

CROSS-REFERENCE TO RELATED APPLICATIONS

This application is a 35 U.S.C. 371 national application of PCT/EP2013/075922 filed Dec. 9, 2013, which claims priority or the benefit under 35 U.S.C. 119 of European application no. 12196059.5 filed Dec. 7, 2012 and U.S. provisional application No. 61/735,121 filed Dec. 10, 2012. The content of each application is fully incorporated herein by reference.

REFERENCE TO A SEQUENCE LISTING

This application contains a Sequence Listing in computer readable form. The computer readable form is incorporated herein by reference.

FIELD OF THE INVENTION

The invention relates to a detergent composition comprising a deoxyribonuclease (DNase), a washing method for textile, a textile washed according to the method and the use of DNase for reducing malodor from laundry and/or textile, for anti-redeposition and for maintaining or improving the whiteness of a textile.

BACKGROUND

When laundry items like T-shirts or sportswear are used, they are exposed to bacteria from the body of the user and from the rest of the environment in which they are used. These bacteria are a source of bad odor, which develops after use, but which may remain even after wash. The reason for this bad odor is adhesion of bacteria to the textile surface. Because of the adhesion to the textile, the bacteria may remain even after wash, and continue to be a source of bad odor.

International patent application WO 2011/098579 concerns bacterial deoxyribonuclease compounds and methods for biofilm disruption and prevention.

The present invention relies on data from a study (see Example 1) of the bacterial diversity in real-life laundry items. Twenty-four bacterial and fungal colonies were isolated from the laundry items, many of which gave rise to very unpleasant smell/malodor.

The present invention provides a solution to odor problem by reducing the adhesion of certain specific bacteria to the textile surface during wash. The selected bacteria are sources of very bad odor, and were isolated from real-life laundry items.

SUMMARY

The present invention provides a detergent composition comprising one or more anionic surfactants; an enzyme selected from the group consisting of: a protease, a lipase, a cutinase, an amylase, a carbohydrase, a cellulase, a pectinase, a mannanase, an arabinase, a galactanase, a xylanase, and an oxidase; and a deoxyribonuclease (DNase).

The invention further concerns a washing method for textile comprising:

a. exposing a textile to a wash liquor comprising a DNase or a detergent composition according to the invention, b. completing at least one wash cycle; and c. optionally rinsing the textile.

The invention further concerns a textile washed according to the inventive method.

And the invention concerns the use of a deoxyribonuclease (DNase) for reducing malodor from laundry and/or textile. for reducing malodor from laundry and/or textile, for anti-redeposition and for maintaining or improving the whiteness of a textile.

Definitions

Enzyme Detergency benefit: The term "enzyme detergency benefit" is defined herein as the advantageous effect an enzyme may add to a detergent compared to the same detergent without the enzyme. Important detergency benefits which can be provided by enzymes are stain removal with no or very little visible soils after washing and/or cleaning, prevention or reduction of redeposition of soils released in the washing process (an effect that also is termed anti-redeposition), restoring fully or partly the whiteness of textiles which originally were white but after repeated use and wash have obtained a greyish or yellowish appearance (an effect that also is termed whitening). Textile care benefits, which are not directly related to catalytic stain removal or prevention of redeposition of soils, are also important for enzyme detergency benefits. Examples of such textile care benefits are prevention or reduction of dye transfer from one fabric to another fabric or another part of the same fabric (an effect that is also termed dye transfer inhibition or anti-backstaining), removal of protruding or broken fibers from a fabric surface to decrease pilling tendencies or remove already existing pills or fuzz (an effect that also is termed anti-pilling), improvement of the fabric-softness, colour clarification of the fabric and removal of particulate soils which are trapped in the fibers of the fabric or garment. Enzymatic bleaching is a further enzyme detergency benefit where the catalytic activity generally is used to catalyze the formation of bleaching components such as hydrogen peroxide or other peroxides.

Textile: The term "textile" means any textile material including yarns, yarn intermediates, fibers, non-woven materials, natural materials, synthetic materials, and any other textile material, fabrics made of these materials and products made from fabrics (e.g., garments and other articles). The textile or fabric may be in the form of knits, wovens, denims, non-wovens, felts, yarns, and towelling. The textile may be cellulose based such as natural cellulosics, including cotton, flax/linen, jute, ramie, sisal or coir or manmade cellulosics (e.g. originating from wood pulp) including viscose/rayon, cellulose acetate fibers (tricell), lyocell or blends thereof. The textile or fabric may also be non-cellulose based such as natural polyamides including wool, camel, cashmere, mohair, rabbit and silk or synthetic polymers such as nylon, aramid, polyester, acrylic, polypropylene and spandex/elastane, or blends thereof as well as blends of cellulose based and non-cellulose based fibers. Examples of blends are blends of cotton and/or rayon/viscose with one or more companion material such as wool, synthetic fiber (e.g. polyamide fiber, acrylic fiber, polyester fiber, polyvinyl chloride fiber, polyurethane fiber, polyurea fiber, aramid fiber), and/or cellulose-containing fiber (e.g. rayon/viscose, ramie, flax/linen, jute, cellulose acetate fiber, lyocell). Fabric may be conventional washable laundry, for example stained household laundry. When the term fabric or garment is used it is intended to include the broader term textiles as well.

Improved wash performance: The term "improved wash performance" is defined herein as a the detergent composition comprising DNase displaying an increased wash performance relative to the wash performance of a reference detergent composition without DNase e.g. by increased removal of malodor or stain removal.

Whiteness: The term "Whiteness" is defined herein as a broad term with different meanings in different regions and for different consumers. Loss of whiteness can e.g. be due to greying, yellowing, or removal of optical brighteners/hueing agents. Greying and yellowing can be due to soil redeposition, body soils, colouring from e.g. iron and copper ions or dye transfer. Whiteness might include one or several issues from the list below: colourant or dye effects; incomplete stain removal (e.g. body soils, sebum etc.); redeposition (greying, yellowing or other discolourations of the object) (removed soils reassociate with other parts of textile, soiled or unsoiled); chemical changes in textile during application; and clarification or brightening of colours.

DETAILED DESCRIPTION

The present invention provides a detergent composition comprising one or more anionic surfactants; an enzyme selected from the group consisting of: a protease, a lipase, a cutinase, an amylase, a carbohydrase, a cellulase, a pectinase, a mannanase, an arabinase, a galactanase, a xylanase, and an oxidase; and a deoxyribonuclease (DNase).

The detergent composition can be used in a washing method for textile comprising:

a. exposing a textile to a wash liquor comprising a DNase or a detergent composition according to the invention, b. completing at least one wash cycle; and c. optionally rinsing the textile.

The invention further concerns the use of a deoxyribonuclease (DNase) for reducing malodor from laundry and/or textile for reducing malodor from laundry and/or textile.

As described above when laundry items like T-shirts or sportswear are used, they are exposed to bacteria from the body of the user and from the rest of the environment in which they are used. These bacteria are a source of bad odor, which develops after use, but which may remain even after wash.

When such textiles are washed, an unpleasant smell may appear when opening the washing machine and the wet laundry items are taken out. This smell or malodor gives the impression that the textile is not clean and needs to be washed again. Even in hand wash laundry methods a malodor could be perceived from the wet laundry items.

One advantage of the present invention is that this malodor does not appear from the wet laundry items i.e. when opening the washing machine. This makes the washing process a more attractive task both in domestic and industrial applications.

Another advantage of the present invention is that, when receiving the wet laundry directly from the washing machine or wash liquor, the laundry items do not have a malodor and are perceived as clean. Thereby time, money and energy for a second or even third wash is saved. This is of huge advantage for the environment.

In conventional laundry methods the malodor may even survive the laundry process and the drying process. This has the effect that malodor can be sensed when the textile is used. This is not very pleasant for the user of the textile, i.e. when wearing sportswear that smells even before the sport activity has started. This can embarrassing for the user of the textile and may even lead to cassation of the textile before it is worn out and by new sportswear. By the use of the present invention this is avoided and the environment is thereby save for use of limited resources such as raw material for new textiles, water, energy and pollution of the environment.

In one embodiment of the invention the anionic surfactant of the detergent composition is selected from the group consisting of: linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis(sulfates), hydroxyalkanesulfonates and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES), secondary alkanesulfonates (SAS), paraffin sulfonates (PS), ester sulfonates, sulfonated fatty acid glycerol esters, alpha-sulfo fatty acid methyl esters (alpha-SFMe or SES), methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid or soap.

In one embodiment the amount of anioinic surfactant is in the range of 1 to 40%, in the range of 5 to 30%, in the range of 5 to 15% or in the range of 20 to 25%.

In one embodiment the amount of detergent builder or co-builder is in the range of 0 to 65%, in the range of 40-65% or in the range of 40 to 65%.

In one embodiment of the invention the composition comprises 10-40 w/w % of a surfactant, 4-50 w/w % of a builder and 0-5 w/w % of a polymer and optionally a filler, solvents and an enzyme stabilizer.

In one embodiment of the invention the detergent composition comprises a. One or more anionic surfactants;

b. An enzyme selected from the group consisting of: a protease, a lipase, a cutinase, an amylase, a carbohydrase, a cellulase, a pectinase, a mannanase, an arabinase, a galactanase, a xylanase, and an oxidase; and c. a deoxyribonuclease (DNase), wherein the DNase is obtainable from a bacterium.

In one embodiment the DNase is ontainable from *Bacillus*.

In one embodiment of the invention the detergent composition comprises a. One or more anionic surfactants;

b. An enzyme selected from the group consisting of: a protease, a lipase, a cutinase, an amylase, a carbohydrase, a cellulase, a pectinase, a mannanase, an arabinase, a galactanase, a xylanase, and an oxidase; and c. a deoxyribonuclease (DNase), wherein the DNase has at least 80% identity to the amino acid sequence shown as amino acids 1 to 110 of SEQ ID NO: 1 or amino acids 1 to 109 of SEQ ID NO: 2.

In one embodiment of the invention the DNase has at least 85% identity to the amino acid sequence shown as amino acids 1 to 110 of SEQ ID NO: 1 or amino acids 1 to 109 of SEQ ID NO: 2.

In one embodiment the DNase has at least 90% identity to the amino acid sequence shown as amino acids 1 to 110 of SEQ ID NO: 1 or amino acids 1 to 109 of SEQ ID NO: 2.

In one embodiment the DNase has at least 95% identity to the amino acid sequence shown as amino acids 1 to 110 of SEQ ID NO: 1 or amino acids 1 to 109 of SEQ ID NO: 2.

In one embodiment the DNase has at least 97% identity to the amino acid sequence shown as amino acids 1 to 110 of SEQ ID NO: 1 or amino acids 1 to 109 of SEQ ID NO: 2.

In one embodiment the DNase has at least 98% identity to the amino acid sequence shown as amino acids 1 to 110 of SEQ ID NO: 1 or amino acids 1 to 109 of SEQ ID NO: 2.

In one embodiment the DNase has at least 99% identity to the amino acid sequence shown as amino acids 1 to 110 of SEQ ID NO: 1 or amino acids 1 to 109 of SEQ ID NO: 2.

In one embodiment the DNase has 100% identity to the amino acid sequence shown as amino acids 1 to 110 of SEQ ID NO: 1 or amino acids 1 to 109 of SEQ ID NO: 2.

In one embodiment the detergent composition of the invention is capable of reducing adhesion of bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis*, and *Stenotrophomonas* sp. to a surface, or releasing the bacteria from a surface to which they adhere. In one embodiment the surface is a textile surface.

In one embodiment the composition is capable of reducing malodor from wet laundry.

In one embodiment the composition is capable of reducing malodor from dry laundry.

In one embodiment of the invention the detergent composition comprises a. One or more anionic surfactants;

b. An enzyme selected from the group consisting of: a protease, a lipase, a cutinase, an amylase, a carbohydrase, a cellulase, a pectinase, a mannanase, an arabinase, a galactanase, a xylanase, and an oxidase; and c. a deoxyribonuclease (DNase), wherein the DNase is obtainable from a bacterium, and the composition is capable of reducing malodor from wet and/or dry laundry.

In one embodiment the DNase is obtainable from *Bacillus*.

In one embodiment of the invention the detergent composition comprises a. One or more anionic surfactants;

b. An enzyme selected from the group consisting of: a protease, a lipase, a cutinase, an amylase, a carbohydrase, a cellulase, a pectinase, a mannanase, an arabinase, a galactanase, a xylanase, and an oxidase; and c. a deoxyribonuclease (DNase), wherein the DNase has at least 80% identity to the amino acid sequence shown as amino acids 1 to 110 of SEQ ID NO: 1 or amino acids 1 to 109 of SEQ ID NO: 2, and the composition is capable of reducing malodor from wet and/or dry laundry.

In one embodiment of the invention the detergent composition comprises a. One or more anionic surfactants;

b. An enzyme selected from the group consisting of: a protease, a lipase, a cutinase, an amylase, a carbohydrase, a cellulase, a pectinase, a mannanase, an arabinase, a galactanase, a xylanase, and an oxidase; and c. a deoxyribonuclease (DNase), wherein the DNase is obtainable from a bacterium, and the composition is capable of reducing the amount of E-2-nonenal from wet and/or dry laundry.

In one embodiment the detergent composition is capable of reducing the amount of E-2-nonenal present on a textile to below 80% of the amount of E-2-nonenal present on the textile before wash.

In one embodiment the detergent composition is capable of reducing the amount of E-2-nonenal present on a textile to below 70%, below 60%, below 50%, below 40%, below 30%, below 20%, below 10% or below 5% of the amount of E-2-nonenal present on the textile before wash or is reduced.

In one embodiment of the invention the composition is a bar, a homogenous tablet, a tablet having two or more layers, a pouch having one or more compartments, a regular or compact powder, a granule, a paste, a gel, or a regular, compact or concentrated liquid.

In one embodiment the composition is a liquid detergent. In one embodiment the composition is a powder or granule detergent.

The invention further concerns a washing method for textile comprising:

a. exposing a textile to a wash liquor comprising a DNase or a detergent composition according to any of claims 1-14, b. completing at least one wash cycle; and c. optionally rinsing the textile.

In one embodiment the pH of the wash liquor is in the range of 7 to 10, preferably 7 to 9 such as 7.5.

In one embodiment of the invention the temperature of the wash liquor is in the range of 5° C. to 95° C., or in the range of 10° C. to 80° C., or in the range of 10° C. to 70° C., or in the range of 10° C. to 60° C., or in the range of 10° C. to 50° C., or in the range of 15° C. to 40° C., or in the range of 20° C. to 30° C.

In a preferred embodiment of the invention the temperature of the wash liquor is in the range of 20° C. to 30° C., for example 30° C.

Washing at low temperatures gives the advantage that energy consumption is reduced. Reducing energy consumption is of advantage to the environment.

In one embodiment of the invention the textile is exposed to a wash liquor during a first and optionally a second and third wash cycle.

In one embodiment the textile is rinsed after being exposed to the wash liquor. In one embodiment a conditioner is used when rinsing the textile.

In one embodiment of the invention there is provided a washing method for textile comprising:

a. exposing a textile to a wash liquor comprising a DNase or a detergent composition according to any of claims 1-14, b. completing at least one wash cycle; and c. optionally rinsing the textile, wherein the malodor of a textile completing steps a-c in the method is reduced.

In one embodiment the malodor of the wet textile is reduced. In one embodiment the malodor of the dry textile is reduced.

In one embodiment the invention concerns the washed textile.

The invention further concerns the use of a deoxyribonuclease (DNase) for reducing malodor from laundry and/or textile.

In one embodiment the malodor comprises E-2-nonenal. In one embodiment the invention concerns the use of DNase for reducing the amount of E-2-nonenal on a textile.

In one embodiment of the invention the amount of E-2-nonenal present on a textile is reduced to below 80% of the amount of E-2-nonenal present on the textile before wash.

In one embodiment the amount of E-2-nonenal present on a textile is reduced to below 70%, below 60%, below 50%, below 40%, below 30%, below 20%, below 10% or below 5% of the amount of E-2-nonenal present on the textile before wash or is reduced.

In one embodiment of the invention the DNase is obtainable from a bacterium.

In one embodiment the DNase is obtainable from *Bacillus*.

The DNases is further described below.

In one embodiment of the invention the whiteness of the textile is maintained or even improved. In one embodiment the redeposition of soil during a wash cycle is reduced.

In one embodiment the invention concerns the use of a deoxyribonuclease (DNase) for reducing malodor from laundry and/or textile.

The DNase can be used for reducing malodor from clothes which have been exposed to direct body contact during normal use, washed at 10-40° C., and subsequently again exposed to direct body contact during normal use.

In one embodiment of the invention the DNase is used for reducing the amount of E-2-nonenal on a textile. The amount of E-2-nonenal present on a textile is reduced to below 80% of the amount of E-2-nonenal present on the textile before wash. In one embodiment the amount of E-2-nonenal present on a textile is reduced to below 70%, below 60%, below 50%, below 40%, below 30%, below 20%, below 10% or below 5% of the amount of E-2-nonenal present on the textile before wash or is reduced.

In one embodiment the DNase is used for maintaining or improving the whiteness of a textile.

In one embodiment the DNase is used for reducing redeposition of soil during a wash cycle.

The DNase is obtainable from a bacterium, e.g. from *Bacillus*.

In one embodiment of the invention the DNase has at least 85% identity to the amino acid sequence shown as amino acids 1 to 110 of SEQ ID NO: 1 or amino acids 1 to 109 of SEQ ID NO: 2.

In one embodiment the DNase has at least 90% identity to the amino acid sequence shown as amino acids 1 to 110 of SEQ ID NO: 1 or amino acids 1 to 109 of SEQ ID NO: 2. In one embodiment the DNase has at least 95% identity to the amino acid sequence shown as amino acids 1 to 110 of SEQ ID NO: 1 or amino acids 1 to 109 of SEQ ID NO: 2.

In one embodiment the DNase has at least 97% identity to the amino acid sequence shown as amino acids 1 to 110 of SEQ ID NO: 1 or amino acids 1 to 109 of SEQ ID NO: 2.

In one embodiment the DNase has at least 98% identity to the amino acid sequence shown as amino acids 1 to 110 of SEQ ID NO: 1 or amino acids 1 to 109 of SEQ ID NO: 2.

In one embodiment the DNase has at least 99% identity to the amino acid sequence shown as amino acids 1 to 110 of SEQ ID NO: 1 or amino acids 1 to 109 of SEQ ID NO: 2.

In one embodiment the DNase has 100% identity to the amino acid sequence shown as amino acids 1 to 110 of SEQ ID NO: 1 or amino acids 1 to 109 of SEQ ID NO: 2.

Deoxyribonuclease (DNase)

A deoxyribonuclease (DNase) is any enzyme that catalyzes the hydrolytic cleavage of phosphodiester linkages in the DNA backbone, thus degrading DNA.

According to the present invention, a DNase which is obtainable from a bacterium is preferred; in particular a DNase which is obtainable from a *Bacillus* is preferred; in particular a DNase which is obtainable from *Bacillus subtilis* or *Bacillus licheniformis* is preferred.

The DNase used in the present invention includes the mature polypeptide of SEQ ID NO: 1, shown as amino acids 1 to 110 (27 to 136) of SEQ ID NO: 1, which is derived from *Bacillus subtilis*; or the mature polypeptide of SEQ ID NO: 2, shown as amino acids 1 to 109 of SEQ ID NO: 2, which is derived from *Bacillus licheniformis*.

The DNase enzyme may comprise or consist of the amino acid sequence shown as amino acids −26 to 110 of SEQ ID NO: 1 (amino acids 1 to 136 of SEQ ID NO: 1) or amino acids −33 to 109 of SEQ ID NO: 2 (amino acids 1 to 142 of SEQ ID NO: 2), or a fragment thereof that has DNase activity, such as the mature polypeptide. A fragment of amino acids −26 to 110 of SEQ ID NO: 1 (amino acids 1 to 136 of SEQ ID NO: 1), or amino acids 1 to 110 of SEQ ID NO: 1 (27 to 136 of SEQ ID NO: 1), is a polypeptide, which has one or more amino acids deleted from the amino and/or carboxyl terminus of SEQ ID NO: 1. A fragment of or amino acids −33 to 109 of SEQ ID NO: 2 (amino acids 1 to 142 of SEQ ID NO: 2), or 1 to 109 of SEQ ID NO: 2 (34 to 142 of SEQ ID NO: 1), is a polypeptide, which has one or more amino acids deleted from the amino and/or carboxyl terminus of SEQ ID NO: 2.

The present invention also provides DNase polypeptides that are substantially homologous to the polypeptides above, and species homologs (paralogs or orthologs) thereof. The term "substantially homologous" is used herein to denote polypeptides being at least 80%, preferably at least 85%, more preferably at least 90%, more preferably at least 95%, even more preferably at least 97% identical, and most preferably at least 99% or more identical to the amino acid sequence of SEQ ID NO: 1 or SEQ ID NO: 2, or a fragment thereof that has DNase activity, or its orthologs or paralogs.

For purposes of the present invention, the sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix. The output of Needle labeled "longest identity" (obtained using the -nobrief option) is used as the percent identity and is calculated as follows:

$$(\text{Identical Residues}\times 100)/(\text{Length of Alignment}-\text{Total Number of Gaps in Alignment})$$

In another embodiment, the DNase of SEQ ID NO: 1 or SEQ ID NO: 2 comprises a substitution, deletion, and/or insertion at one or more (e.g., several) positions. In an embodiment, the number of amino acid substitutions, deletions and/or insertions introduced into the mature polypeptide of SEQ ID NO: 1 or SEQ ID NO: 2 is not more than 10, e.g., 1, 2, 3, 4, 5, 6, 7, 8 or 9. The amino acid changes may be of a minor nature, that is conservative amino acid substitutions or insertions that do not significantly affect the folding and/or activity of the protein; small deletions, typically of 1-30 amino acids; small amino- or carboxyl-terminal extensions, such as an amino-terminal methionine residue; a small linker peptide of up to 20-25 residues; or a small extension that facilitates purification by changing net charge or another function, such as a poly-histidine tract, an antigenic epitope or a binding domain.

Examples of conservative substitutions are within the groups of basic amino acids (arginine, lysine and histidine), acidic amino acids (glutamic acid and aspartic acid), polar amino acids (glutamine and asparagine), hydrophobic amino acids (leucine, isoleucine and valine), aromatic amino acids (phenylalanine, tryptophan and tyrosine), and small amino acids (glycine, alanine, serine, threonine and methionine). Amino acid substitutions that do not generally alter specific activity are known in the art and are described, for example, by H. Neurath and R. L. Hill, 1979, *In, The Proteins*, Academic Press, New York. Common substitutions are Ala/Ser, Val/Ile, Asp/Glu, Thr/Ser, Ala/Gly, Ala/Thr, Ser/Asn, Ala/Val, Ser/Gly, Tyr/Phe, Ala/Pro, Lys/Arg, Asp/Asn, Leu/Ile, Leu/Val, Ala/Glu, and Asp/Gly.

Alternatively, the amino acid changes are of such a nature that the physico-chemical properties of the polypeptides are altered. For example, amino acid changes may improve the thermal stability of the polypeptide, alter the substrate specificity, change the pH optimum, and the like.

Essential amino acids in a polypeptide can be identified according to procedures known in the art, such as site-directed mutagenesis or alanine-scanning mutagenesis (Cunningham and Wells, 1989, *Science* 244: 1081-1085). In the latter technique, single alanine mutations are introduced at every residue in the molecule, and the resultant mutant molecules are tested for DNase activity to identify amino acid residues that are critical to the activity of the molecule. See also, Hilton et al., 1996, *J. Biol. Chem.* 271: 4699-4708. The active site of the enzyme or other biological interaction can also be determined by physical analysis of structure, as determined by such techniques as nuclear magnetic resonance, crystallography, electron diffraction, or photoaffinity labeling, in conjunction with mutation of putative contact site amino acids. See, for example, de Vos et al., 1992, *Science* 255: 306-312; Smith et al., 1992, *J. Mol. Biol.* 224: 899-904; Wlodaver et al., 1992, *FEBS Lett.* 309: 59-64. The identity of essential amino acids can also be inferred from an alignment with a related polypeptide.

Single or multiple amino acid substitutions, deletions, and/or insertions can be made and tested using known methods of mutagenesis, recombination, and/or shuffling, followed by a relevant screening procedure, such as those disclosed by Reidhaar-Olson and Sauer, 1988, *Science* 241: 53-57; Bowie and Sauer, 1989, *Proc. Natl. Acad. Sci. USA* 86: 2152-2156; WO 95/17413; or WO 95/22625. Other methods that can be used include error-prone PCR, phage display (e.g., Lowman et al., 1991, *Biochemistry* 30: 10832-10837; U.S. Pat. No. 5,223,409; WO 92/06204), and region-directed mutagenesis (Derbyshire et al., 1986, *Gene* 46: 145; Ner et al., 1988, *DNA* 7: 127).

Mutagenesis/shuffling methods can be combined with high-throughput, automated screening methods to detect activity of cloned, mutagenized polypeptides expressed by host cells (Ness et al., 1999, *Nature Biotechnology* 17: 893-896). Mutagenized DNA molecules that encode active polypeptides can be recovered from the host cells and rapidly sequenced using standard methods in the art. These methods allow the rapid determination of the importance of individual amino acid residues in a polypeptide.

The polypeptide may be a hybrid polypeptide in which a region of one polypeptide is fused at the N-terminus or the C-terminus of a region of another polypeptide.

The polypeptide may be a fusion polypeptide or cleavable fusion polypeptide in which another polypeptide is fused at the N-terminus or the C-terminus of the polypeptide of the present invention. A fusion polypeptide is produced by fusing a polynucleotide encoding another polypeptide to a polynucleotide of the present invention. Techniques for producing fusion polypeptides are known in the art, and include ligating the coding sequences encoding the polypeptides so that they are in frame and that expression of the fusion polypeptide is under control of the same promoter(s) and terminator. Fusion polypeptides may also be constructed using intein technology in which fusion polypeptides are created post-translationally (Cooper et al., 1993, *EMBO J.* 12: 2575-2583; Dawson et al., 1994, *Science* 266: 776-779).

A fusion polypeptide can further comprise a cleavage site between the two polypeptides. Upon secretion of the fusion protein, the site is cleaved releasing the two polypeptides. Examples of cleavage sites include, but are not limited to, the sites disclosed in Martin et al., 2003, *J. Ind. Microbiol. Biotechnol.* 3: 568-576; Svetina et al., 2000, *J. Biotechnol.* 76: 245-251; Rasmussen-Wilson et al., 1997, *Appl. Environ. Microbiol.* 63: 3488-3493; Ward et al., 1995, *Biotechnology* 13: 498-503; and Contreras et al., 1991, *Biotechnology* 9: 378-381; Eaton et al., 1986, *Biochemistry* 25: 505-512; Collins-Racie et al., 1995, *Biotechnology* 13: 982-987; Carter et al., 1989, *Proteins: Structure, Function, and Genetics* 6: 240-248; and Stevens, 2003, *Drug Discovery World* 4: 35-48.

The concentration of the DNase is typically in the range of 0.0004-100 ppm enzyme protein, 0.001-100 ppm enzyme protein, 0.01-100 ppm enzyme protein, preferably 0.05-50 ppm enzyme protein, more preferably 0.1-50 ppm enzyme protein, more preferably 0.1-30 ppm enzyme protein, more preferably 0.5-20 ppm enzyme protein, and most preferably 0.5-10 ppm enzyme protein.

In an embodiment, the concentration of the DNase is typically in the range of 1-40 ppm enzyme protein, preferably 1-20 ppm enzyme protein, more preferably 1-10 ppm enzyme protein.

Detergent Composition

In one aspect of the invention, the DNase is added to and thus becomes a component of a detergent composition.

The detergent composition of the present invention may be formulated, for example, as a hand or machine laundry detergent composition including a laundry additive composition suitable for pre-treatment of stained fabrics and a rinse added fabric softener composition, or be formulated as a detergent composition for use in general household hard surface cleaning operations, or be formulated for hand or machine dishwashing operations.

Surfactants

The detergent composition may comprise one or more surfactants, which may be anionic and/or cationic and/or non-ionic and/or semi-polar and/or zwitterionic, or a mixture thereof. In a particular embodiment, the detergent composition includes a mixture of one or more nonionic surfactants and one or more anionic surfactants. The surfactant(s) is typically present at a level of from about 0.1% to 60% by weight, such as about 1% to about 40%, or about 3% to about 20%, or about 3% to about 10%. The surfactant(s) is chosen based on the desired cleaning application, and includes any conventional surfactant(s) known in the art.

When included therein the detergent will usually contain from about 1% to about 40% by weight, such as from about 5% to about 30%, including from about 5% to about 15%, or from about 20% to about 25% of an anionic surfactant. Non-limiting examples of anionic surfactants include sulfates and sulfonates, in particular, linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis(sulfates), hydroxyalkanesulfonates and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES, also known as alcohol ethoxysulfates or fatty alcohol ether sulfates), secondary alkanesulfonates (SAS), paraffin sulfonates (PS), ester sulfonates, sulfonated fatty acid glycerol esters, alpha-sulfo fatty acid methyl esters (alpha-SFMe or SES) including methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid or soap, and combinations thereof.

When included therein the detergent will usually contain from about 0.2% to about 40% by weight of a non-ionic surfactant, for example from about 0.5% to about 30%, in particular from about 1% to about 20%, from about 3% to about 10%, such as from about 3% to about 5%, or from about 8% to about 12%. Non-limiting examples of non-ionic surfactants include alcohol ethoxylates (AE or AEO), alcohol propoxylates, propoxylated fatty alcohols (PFA), alkoxylated fatty acid alkyl esters, such as ethoxylated and/or propoxylated fatty acid alkyl esters, alkylphenol ethoxylates (APE), nonylphenol ethoxylates (NPE), alkylpolyglycosides (APG), alkoxylated amines, fatty acid monoethanolamides (FAM), fatty acid diethanolamides (FADA), ethoxylated fatty acid monoethanolamides (EFAM), propoxylated fatty acid monoethanolamide (PFAM), polyhydroxy alkyl fatty acid amides, or N-acyl N-alkyl derivatives of glucosamine (glucamides, GA, or fatty acid glucamide, FAGA), as well as products available under the trade names SPAN and TWEEN, and combinations thereof.

When included therein the detergent will usually contain from about from about 1% to about 40% by weigh of a cationic surfactant, for example from about 0.5% to about 30%, in particular from about 1% to about 20%, from about 3% to about 10%, such as from about 3% to about 5%, from about 8% to about 12% or from about 10% to about 12%. Non-limiting examples of cationic surfactants include alkyldimethylethanolamine quat (ADMEAQ), cetyltrimethylammonium bromide (CTAB), dimethyldistearylammonium chloride (DSDMAC), and alkylbenzyldimethylammonium, alkyl quaternary ammonium compounds, alkoxylated quaternary ammonium (AQA) compounds, ester quats, and combinations thereof.

Builders and Co-Builders

The detergent composition may contain about 0-65% by weight, such as about 5% to about 50% of a detergent builder or co-builder, or a mixture thereof. In a dish wash detergent, the level of builder is typically 40-65%, particularly 50-65%. The builder and/or co-builder may particularly be a chelating agent that forms water-soluble complexes with Ca and Mg. Any builder and/or co-builder known in the art for use in laundry detergents may be utilized. Non-limiting examples of builders include zeolites, diphosphates (pyrophosphates), triphosphates such as sodium triphosphate (STP or STPP), carbonates such as sodium carbonate, soluble silicates such as sodium metasilicate, layered silicates (e.g., SKS-6 from Hoechst), ethanolamines such as 2-aminoethan-1-ol (MEA), diethanolamine (DEA, also known as 2,2'-iminodiethan-1-ol), triethanolamine (TEA, also known as 2,2',2"-nitrilotriethan-1-ol), and (carboxymethyl)inulin (CMI), and combinations thereof.

The detergent composition may contain about 0-65% by weight of a detergent builder or co-builder, or a mixture thereof. In a dish wash detergent, the level of builder is typically 40-65%, particularly 50-65%. The builder and/or co-builder may particularly be a chelating agent that forms water-soluble complexes with Ca and Mg. Any builder and/or co-builder known in the art for use in laundry detergents may be utilized. Non-limiting examples of builders include zeolites, diphosphates (pyrophosphates), triphosphates such as sodium triphosphate (STP or STPP), carbonates such as sodium carbonate, soluble silicates such as sodium metasilicate, layered silicates (e.g., SKS-6 from Hoechst), ethanolamines such as 2-aminoethan-1-ol (MEA), iminodiethanol (DEA) and 2,2',2"-nitrilotriethanol (TEA), and carboxymethylinulin (CMI), and combinations thereof.

The detergent composition may also contain 0-50% by weight, such as about 5% to about 30%, of a detergent co-builder. The detergent composition may include a co-builder alone, or in combination with a builder, for example a zeolite builder. Non-limiting examples of co-builders include homopolymers of polyacrylates or copolymers thereof, such as poly(acrylic acid) (PAA) or copoly(acrylic acid/maleic acid) (PAA/PMA). Further non-limiting examples include citrate, chelators such as aminocarboxylates, aminopolycarboxylates and phosphonates, and alkyl- or alkenylsuccinic acid. Additional specific examples include 2,2',2"-nitrilotriacetic acid (NTA), ethylenediaminetetraacetic acid (EDTA), diethylenetriaminepentaacetic acid (DTPA), iminodisuccinic acid (IDS), ethylenediamine-N,N'-disuccinic acid (EDDS), methylglycinediacetic acid (MGDA), glutamic acid-N,N-diacetic acid (GLDA), 1-hydroxyethane-1,1-diphosphonic acid (HEDP), ethylenediaminetetra(methylenephosphonic acid) (EDTMPA), diethylenetriaminepentakis(methylenephosphonic acid) (DTMPA or DTPMPA), N-(2-hydroxyethyl)iminodiacetic acid (EDG), aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl)-aspartic acid (SMAS), N-(2-sulfoethyl)-aspartic acid (SEAS), N-(2-sulfomethyl)-glutamic acid (SMGL), N-(2-sulfoethyl)-glutamic acid (SEGL), N-methyliminodiacetic acid (MIDA), α-alanine-N,N-diacetic acid (α-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA), N-(2-hydroxyethyl)ethylenediamine-N,N,N"-triacetic acid (HEDTA), diethanolglycine (DEG), diethylenetriamine penta (methylenephosphonic acid) (DTPMP), aminotris (methylenephosphonic acid) (ATMP), and combinations and salts thereof. Further exemplary builders and/or co-builders are described in, e.g., WO 09/102854, U.S. Pat. No. 5,977,053

Bleaching Systems

The detergent composition may contain 0-50% by weight of a bleaching system. Any bleaching system known in the art for use in laundry detergents may be utilized. Suitable bleaching system components include bleaching catalysts, photobleaches, bleach activators, sources of hydrogen peroxide such as sodium percarbonate and sodium perborates, preformed peracids and mixtures thereof. Suitable preformed peracids include, but are not limited to, peroxycarboxylic acids and salts, percarbonic acids and salts, perimidic acids and salts, peroxymonosulfuric acids and salts, for example, Oxone®, and mixtures thereof. Non-limiting examples of bleaching systems include peroxide-based bleaching systems, which may comprise, for example, an inorganic salt, including alkali metal salts such as sodium salts of perborate (usually mono- or tetra-hydrate), percarbonate, persulfate, perphosphate, persilicate salts, in combination with a peracid-forming bleach activator. By Bleach activator is meant herin a compound which reacts with peroxygen bleach like hydrogen peroxide to form a Peracid. The peracid thus formed constitutes the activated bleach. Suitable bleach activators to be used herein include those belonging to the class of esters amides, imides or anhydrides, Suitable examples are tetracetyl athylene diamine (TAED), sodium 3,5,5 trimethyl hexanoyloxybenzene sulphonat, diperoxy dodecanoic acid, 4-(dodecanoyloxy)benzenesulfonate (LOBS), 4-(decanoyloxy)benzenesulfonate, 4-(decanoyloxy)benzoate (DOBS), 4-(3,5,5-trimethylhexanoyloxyl)benzenesulfonate (ISONOBS), tetraacetylethylenediamine (TAED) and 4-(nonanoyloxy)benzenesulfonate (NOBS), and/or those disclosed in WO98/17767. A particular family of bleach activators of interest was disclosed in EP624154 and particularly preferred in that family is acetyl triethyl citrate (ATC). ATC or a short chain triglyceride like Triacin has the advantage that it is environmental friendly as it eventually degrades into citric acid and alcohol. Furthermore acethyl triethyl citrate and triacetin has a good hydrolytical stability in the product upon storage and it is an efficient bleach activator. Finally ATC provides a good building capacity to the laundry additive. Alternatively, the bleaching system may comprise peroxyacids of, for example, the amide, imide, or sulfone type. The bleaching system may also comprise peracids such as 6-(phthaloylamino)percapronic acid (PAP). The bleaching system may also include a bleach catalyst.

Polymers

The detergent may contain 0-10% by weight, such as 0.5-5%, 2-5%, 0.5-2% or 0.2-1% of a polymer. Any polymer known in the art for use in detergents may be utilized. The polymer may function as a co-builder as mentioned above, or may provide antiredeposition, fiber protection, soil release, dye transfer inhibition, grease cleaning and/or anti-foaming properties. Some polymers may have more than one of the above-mentioned properties and/or more than one of the below-mentioned motifs. Exemplary polymers include (carboxymethyl)cellulose (CMC), poly(vinyl alcohol) (PVA), poly(vinylpyrrolidone) (PVP), poly(ethyleneglycol) or poly(ethylene oxide) (PEG), ethoxylated poly (ethyleneimine), carboxymethyl inulin (CMI), and polycarboxylates such as PAA, PAA/PMA, poly-aspartic acid, and lauryl methacrylate/acrylic acid copolymers, hydrophobically modified CMC (HM-CMC) and silicones, copolymers of terephthalic acid and oligomeric glycols, copolymers of poly(ethylene terephthalate) and poly (oxyethene terephthalate) (PET-POET), PVP, poly(vinylimidazole) (PVI), poly(vinylpyridine-N-oxide) (PVPO or PVPNO) and polyvinylpyrrolidone-vinylimidazole (PVPVI). Further exemplary polymers include sulfonated polycarboxylates, polyethylene oxide and polypropylene oxide (PEO-PPO) and diquaternium ethoxy sulfate. Other exemplary polymers are disclosed in, e.g., WO 2006/130575. Salts of the above-mentioned polymers are also contemplated.

Fabric Hueing Agents

The detergent compositions of the present invention may also include fabric hueing agents such as dyes or pigments, which when formulated in detergent compositions can deposit onto a fabric when said fabric is contacted with a wash liquor comprising said detergent compositions and thus altering the tint of said fabric through absorption/reflection of visible light. Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example as described in WO2005/03274, WO2005/03275, WO2005/03276 and EP1876226 (hereby incorporated by reference). The detergent composition preferably comprises from about 0.00003 wt % to about 0.2 wt %, from about 0.00008 wt % to about 0.05 wt %, or even from about 0.0001 wt % to about 0.04 wt % fabric hueing agent. The composition may comprise from 0.0001 wt % to 0.2 wt % fabric hueing agent, this may be especially preferred when the composition is in the form of a unit dose pouch. Suitable hueing agents are also disclosed in, e.g. WO 2007/087257 and WO2007/087243.

Other ingredients of the detergent composition, which are all well-known in art, include hydrotropes, fabric hueing agents, anti-foaming agents, soil release polymers, anti-redeposition agents etc.

The detergent additive as well as the detergent composition may comprise one or more additional enzymes such as a protease, lipase, cutinase, amylase, carbohydrase, cellulase, pectinase, mannanase, arabinase, galactanase, xylanase, oxidase, e.g., a laccase, and/or peroxidase.

The polypeptide of the present invention may be added to a detergent composition in an amount corresponding to at least 1 mg of DNase protein, such as at least 5 mg of protein, preferably at least 10 mg of protein, more preferably at least 15 mg of protein, even more preferably at least 20 mg of protein, most preferably at least 30 mg of protein, and even most preferably at least 40 mg of protein per liter of wash liquor. Thus, the detergent composition may comprise at least 0.1% DNase protein, preferably at least 0.2%, 0.3%, 0.4%, 0.5%, 0.6%, 0.8%, 1.0%, 1.2%, 1.5%, or 2.0% of DNase protein.

Compositions comprising a DNase for use in the methods of the invention may be formulated as a liquid (e.g. aqueous), a solid, a gel, a paste or a dry product formulation. The dry product formulation may subsequently be re-hydrated to form an active liquid or semi-liquid formulation usable in the methods of the invention.

The compositions of the invention may further comprise auxiliary agents such as wetting agents, thickening agents, buffer(s) for pH control, stabilisers, perfume, colourants, fillers and the like.

Useful wetting agents are surfactants, i.e. non-ionic, anionic, amphoteric or zwitterionic surfactants. Surfactants are further described above.

Enzymes

The detergent additive as well as the detergent composition may comprise one or more additional enzymes such as a protease, lipase, cutinase, an amylase, carbohydrase, cellulase, pectinase, mannanase, arabinase, galactanase, xylanase, oxidase, e.g., a laccase, and/or peroxidase.

In general the properties of the selected enzyme(s) should be compatible with the selected detergent, (i.e., pH-optimum, compatibility with other enzymatic and non-enzymatic ingredients, etc.), and the enzyme(s) should be present in effective amounts.

Cellulases

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. Nos. 4,435,307, 5,648,263, 5,691,178, 5,776,757 and WO 89/09259.

Especially suitable cellulases are the alkaline or neutral cellulases having colour care benefits. Examples of such cellulases are cellulases described in EP 0 495 257, EP 0 531 372, WO 96/11262, WO 96/29397, WO 98/08940. Other examples are cellulase variants such as those described in WO 94/07998, EP 0 531 315, U.S. Pat. Nos. 5,457,046, 5,686,593, 5,763,254, WO 95/24471, WO 98/12307 and WO99/001544.

Other cellulases are endo-beta-1,4-glucanase enzyme having a sequence of at least 97% identity to the amino acid sequence of position 1 to position 773 of SEQ ID NO:2 of WO 2002/099091 or a family 44 xyloglucanase, which a xyloglucanase enzyme having a sequence of at least 60% identity to positions 40-559 of SEQ ID NO: 2 of WO 2001/062903.

Commercially available cellulases include Celluzyme™, and Carezyme™ (Novozymes A/S) Carezyme Premium™ (Novozymes A/S), Celluclean™ (Novozymes A/S), Celluclean Classic™ (Novozymes A/S), Cellusoft™ (Novozymes A/S), Whitezyme™ (Novozymes A/S), Clazinase™, and Puradax HA™ (Genencor International Inc.), and KAC-500(B)™ (Kao Corporation).

Proteases

Suitable proteases include those of bacterial, fungal, plant, viral or animal origin e.g. vegetable or microbial origin. Microbial origin is preferred. Chemically modified or protein engineered mutants are included. It may be an alkaline protease, such as a serine protease or a metalloprotease. A serine protease may for example be of the 51 family, such as trypsin, or the S8 family such as subtilisin. A metalloproteases protease may for example be a thermolysin from e.g. family M4 or other metalloprotease such as those from M5, M7 or M8 families.

The term "subtilases" refers to a sub-group of serine protease according to Siezen et al., Protein Engng. 4 (1991) 719-737 and Siezen et al. Protein Science 6 (1997) 501-523. Serine proteases are a subgroup of proteases characterized by having a serine in the active site, which forms a covalent adduct with the substrate. The subtilases may be divided into 6 sub-divisions, i.e. the Subtilisin family, the Thermitase family, the Proteinase K family, the Lantibiotic peptidase family, the Kexin family and the Pyrolysin family.

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO09/021867, and subtilisin *lentus*, subtilisin Novo, subtilisin Carlsberg, *Bacillus licheniformis*, subtilisin BPN', subtilisin 309, subtilisin 147 and subtilisin 168 described in WO89/06279 and protease PD138 described in (WO93/18140). Other useful proteases may be those described in WO92/175177, WO01/016285, WO02/026024 and WO02/016547. Examples of trypsin-like proteases are trypsin (e.g. of porcine or bovine origin) and the *Fusarium* protease described in WO89/06270, WO94/25583 and WO05/040372, and the chymotrypsin proteases derived from Cellumonas described in WO05/052161 and WO05/052146.

A further preferred protease is the alkaline protease from *Bacillus lentus* DSM 5483, as described for example in WO95/23221, and variants thereof which are described in WO92/21760, WO95/23221, EP1921147 and EP1921148.

Examples of metalloproteases are the neutral metalloprotease as described in WO07/044993 (Genencor Int.) such as those derived from *Bacillus amyloliquefaciens*.

Examples of useful proteases are the variants described in: WO92/19729, WO96/034946, WO98/20115, WO98/20116, WO99/011768, WO01/44452, WO03/006602, WO04/03186, WO04/041979, WO07/006305, WO11/036263, WO11/036264, especially the variants with substitutions in one or more of the following positions: 3, 4, 9, 15, 27, 36, 57, 68, 76, 87, 95, 96, 97, 98, 99, 100, 101, 102, 103, 104, 106, 118, 120, 123, 128, 129, 130, 160, 167, 170, 194, 195, 199, 205, 206, 217, 218, 222, 224, 232, 235, 236, 245, 248, 252 and 274 using the BPN' numbering. More preferred the subtilase variants may comprise the mutations: S3T, V4I, S9R, A15T, K27R, *36D, V68A, N76D, N87S,R, *97E, A98S, S99G,D,A, S99AD, S101G,M,R S103A, V104I,Y,N, S106A, G118V,R, H120D,N, N123S, 5128L, P129Q, S130A, G160D, Y167A, R170S, A194P, G195E, V199M, V205I, L217D, N218D, M222S, A232V, K235L, Q236H, Q245R, N252K, T274A (using BPN' numbering).

Suitable commercially available protease enzymes include those sold under the trade names Alcalase®, Duralase™, Durazym™, Relase®, Relase® Ultra, Savinase®, Savinase® Ultra, Primase®, Polarzyme®, Kannase®, Liquanase®, Liquanase® Ultra, Ovozyme®, Coronase®, Coronase® Ultra, Neutrase®, Everlase® and Esperase® (Novozymes A/S), those sold under the tradename Maxatase®, Maxacal®, Maxapem®, Purafect®, Purafect Prime®, Preferenz™, Purafect MA®, Purafect Ox®, Purafect OxP®, Puramax®, Properase®, Effectenz™, FN2®, FN3®, FN4®, Excellase®, Opticlean® and Optimase® (Danisco/DuPont), Axapem™ (Gist-Brocases N.V.), BLAP (sequence shown in FIG. 29 of U.S. Pat. No. 5,352,604) and variants hereof (Henkel AG) and KAP (*Bacillus alkalophilus* subtilisin) from Kao.

Lipases and Cutinases:

Suitable lipases and cutinases include those of bacterial or fungal origin. Chemically modified or protein engineered mutant enzymes are included. Examples include lipase from Thermomyces, e.g. from *T. lanuginosus* (previously named *Humicola lanuginosa*) as described in EP258068 and EP305216, cutinase from *Humicola*, e.g. *H. insolens* (WO96/13580), lipase from strains of *Pseudomonas* (some of these now renamed to *Burkholderia*), e.g. *P. alcaligenes* or *P. pseudoalcaligenes* (EP218272), *P. cepacia* (EP331376), *P.* sp. strain SD705 (WO95/06720 & WO96/27002), *P. wisconsinensis* (WO96/12012), GDSL-type *Streptomyces* lipases (WO10/065455), cutinase from *Magnaporthe grisea* (WO10/107560), cutinase from *Pseudomonas mendocina* (U.S. Pat. No. 5,389,536), lipase from *Thermobifida fusca* (WO11/084412), *Geobacillus stearothermophilus* lipase (WO11/084417), lipase from *Bacillus subtilis* (WO11/084599), and lipase from *Streptomyces griseus* (WO11/150157) and *S. pristinaespiralis* (WO12/137147).

Other examples are lipase variants such as those described in EP407225, WO92/05249, WO94/01541, WO94/25578, WO95/14783, WO95/30744, WO95/35381, WO95/22615, WO96/00292, WO97/04079, WO97/07202, WO00/34450, WO00/60063, WO01/92502, WO07/87508 and WO09/109500.

Preferred commercial lipase products include Lipolase™, Lipex™; Lipolex™ and Lipoclean™ (Novozymes A/S), Lumafast (originally from Genencor) and Lipomax (originally from Gist-Brocades).

Still other examples are lipases sometimes referred to as acyltransferases or perhydrolases, e.g. acyltransferases with homology to *Candida antarctica* lipase A (WO10/111143), acyltransferase from *Mycobacterium smegmatis* (WO05/56782), perhydrolases from the CE 7 family (WO09/67279), and variants of the *M. smegmatis* perhydrolase in particular the S54V variant used in the commercial product Gentle Power Bleach from Huntsman Textile Effects Pte Ltd (WO10/100028).

Amylases:

Suitable amylases which can be used together with the DNase may be an alpha-amylase or a glucoamylase and may be of bacterial or fungal origin. Chemically modified or protein engineered mutants are included. Amylases include, for example, alpha-amylases obtained from *Bacillus*, e.g., a special strain of *Bacillus licheniformis*, described in more detail in GB 1,296,839.

Suitable amylases include amylases having SEQ ID NO: 2 in WO 95/10603 or variants having 90% sequence identity to SEQ ID NO: 3 thereof. Preferred variants are described in WO 94/02597, WO 94/18314, WO 97/43424 and SEQ ID NO: 4 of WO 99/019467, such as variants with substitutions in one or more of the following positions: 15, 23, 105, 106, 124, 128, 133, 154, 156, 178, 179, 181, 188, 190, 197, 201, 202, 207, 208, 209, 211, 243, 264, 304, 305, 391, 408, and 444.

Different suitable amylases include amylases having SEQ ID NO: 6 in WO 02/010355 or variants thereof having 90% sequence identity to SEQ ID NO: 6. Preferred variants of SEQ ID NO: 6 are those having a deletion in positions 181 and 182 and a substitution in position 193.

Other amylases which are suitable are hybrid alpha-amylase comprising residues 1-33 of the alpha-amylase derived from *B. amyloliquefaciens* shown in SEQ ID NO: 6 of WO 2006/066594 and residues 36-483 of the *B. licheniformis* alpha-amylase shown in SEQ ID NO: 4 of WO 2006/066594 or variants having 90% sequence identity thereof. Preferred variants of this hybrid alpha-amylase are those having a substitution, a deletion or an insertion in one of more of the following positions: G48, T49, G107, H156, A181, N190, M197, I201, A209 and Q264. Most preferred variants of the hybrid alpha-amylase comprising residues 1-33 of the alpha-amylase derived from *B. amyloliquefaciens* shown in SEQ ID NO: 6 of WO 2006/066594 and residues 36-483 of SEQ ID NO: 4 are those having the substitutions:

M197T;

H156Y+A181T+N190F+A209V+Q264S; or

G48A+T491+G107A+H156Y+A181T+N190F+I201F+A209V+Q264S.

Further amylases which are suitable are amylases having SEQ ID NO: 6 in WO 99/019467 or variants thereof having 90% sequence identity to SEQ ID NO: 6. Preferred variants of SEQ ID NO: 6 are those having a substitution, a deletion or an insertion in one or more of the following positions: R181, G182, H183, G184, N195, I206, E212, E216 and K269. Particularly preferred amylases are those having deletion in positions R181 and G182, or positions H183 and G184.

Additional amylases which can be used are those having SEQ ID NO: 1, SEQ ID NO: 3, SEQ ID NO: 2 or SEQ ID NO: 7 of WO 96/023873 or variants thereof having 90% sequence identity to SEQ ID NO: 1, SEQ ID NO: 2, SEQ ID NO: 3 or SEQ ID NO: 7. Preferred variants of SEQ ID NO: 1, SEQ ID NO: 2, SEQ ID NO: 3 or SEQ ID NO: 7 are those having a substitution, a deletion or an insertion in one or more of the following positions: 140, 181, 182, 183, 184, 195, 206, 212, 243, 260, 269, 304 and 476, using SEQ ID 2 of WO 96/023873 for numbering. More preferred variants are those having a deletion in two positions selected from 181, 182, 183 and 184, such as 181 and 182, 182 and 183, or positions 183 and 184. Most preferred amylase variants of SEQ ID NO: 1, SEQ ID NO: 2 or SEQ ID NO: 7 are those having a deletion in positions 183 and 184 and a substitution in one or more of positions 140, 195, 206, 243, 260, 304 and 476.

Other amylases which can be used are amylases having SEQ ID NO: 2 of WO 08/153815, SEQ ID NO: 10 in WO 01/66712 or variants thereof having 90% sequence identity to SEQ ID NO: 2 of WO 08/153815 or 90% sequence identity to SEQ ID NO: 10 in WO 01/66712. Preferred variants of SEQ ID NO: 10 in WO 01/66712 are those having a substitution, a deletion or an insertion in one of more of the following positions: 176, 177, 178, 179, 190, 201, 207, 211 and 264.

Further suitable amylases are amylases having SEQ ID NO: 2 of WO 09/061380 or variants having 90% sequence identity to SEQ ID NO: 2 thereof. Preferred variants of SEQ ID NO: 2 are those having a truncation of the C-terminus and/or a substitution, a deletion or an insertion in one of more of the following positions: Q87, Q98, S125, N128, T131, T165, K178, R180, S181, T182, G183, M201, F202, N225, S243, N272, N282, Y305, R309, D319, Q320, Q359, K444 and G475. More preferred variants of SEQ ID NO: 2 are those having the substitution in one of more of the following positions: Q87E,R, Q98R, S125A, N128C, T131I, T165I, K178L, T182G, M201L, F202Y, N225E,R, N272E, R, S243Q,A,E,D, Y305R, R309A, Q320R, Q359E, K444E and G475K and/or deletion in position R180 and/or S181 or of T182 and/or G183. Most preferred amylase variants of SEQ ID NO: 2 are those having the substitutions:

N128C+K178L+T182G+Y305R+G475K;

N128C+K178L+T182G+F202Y+Y305R+D319T+G475K;

S125A+N128C+K178L+T182G+Y305R+G475K; or

S125A+N128C+T131I+T165I+K178L+T182G+Y305R+G475K wherein the variants are C-terminally truncated and optionally further comprises a substitution at position 243 and/or a deletion at position 180 and/or position 181.

Other suitable amylases are the alpha-amylase having SEQ ID NO: 12 in WO01/66712 or a variant having at least 90% sequence identity to SEQ ID NO: 12. Preferred amylase variants are those having a substitution, a deletion or an insertion in one of more of the following positions of SEQ ID NO: 12 in WO01/66712: R28, R118, N174; R181, G182, D183, G184, G186, W189, N195, M202, Y298, N299, K302, S303, N306, R310, N314; R320, H324, E345, Y396, R400, W439, R444, N445, K446, Q449, R458, N471, N484. Particular preferred amylases include variants having a deletion of D183 and G184 and having the substitutions R118K, N195F, R320K and R458K, and a variant additionally having substitutions in one or more position selected from the group: M9, G149, G182, G186, M202, T257, Y295, N299, M323, E345 and A339, most preferred a variant that additionally has substitutions in all these positions.

Other examples are amylase variants such as those described in WO2011/098531, WO2013/001078 and WO2013/001087.

Commercially available amylases are Duramyl™, Termamyl™, Fungamyl™, Stainzyme™, Stainzyme Plus™, Natalase™, Liquozyme X and BAN™ (from Novozymes A/S), and Rapidase™, Purastar™/Effectenz™, Powerase and Preferenz S100 (from Genencor International Inc./DuPont).

Peroxidases/Oxidases

Suitable peroxidases/oxidases include those of plant, bacterial or fungal origin. Chemically modified or protein engineered mutants are included. Examples of useful peroxidases include peroxidases from *Coprinus*, e.g., from *C. cinereus*, and variants thereof as those described in WO 93/24618, WO 95/10602, and WO 98/15257.

Commercially available peroxidases include Guardzyme™ (Novozymes A/S).

The detergent enzyme(s) may be included in a detergent composition by adding separate additives containing one or more enzymes, or by adding a combined additive comprising all of these enzymes. A detergent additive of the invention, i.e., a separate additive or a combined additive, can be formulated, for example, as a granulate, liquid, slurry, etc.

Preferred detergent additive formulations are granulates, in particular non-dusting granulates, liquids, in particular stabilized liquids, or slurries.

Non-dusting granulates may be produced, e.g. as disclosed in U.S. Pat. Nos. 4,106,991 and 4,661,452 and may optionally be coated by methods known in the art. Examples of waxy coating materials are poly(ethylene oxide) products (polyethyleneglycol, PEG) with mean molar weights of 1000 to 20000; ethoxylated nonylphenols having from 16 to 50 ethylene oxide units; ethoxylated fatty alcohols in which the alcohol contains from 12 to 20 carbon atoms and in which there are 15 to 80 ethylene oxide units; fatty alcohols; fatty acids; and mono- and di- and triglycerides of fatty acids. Examples of film-forming coating materials suitable for application by fluid bed techniques are given in GB 1483591. Liquid enzyme preparations may, for instance, be stabilized by adding a polyol such as propylene glycol, a sugar or sugar alcohol, lactic acid or boric acid according to established methods. Protected enzymes may be prepared according to the method disclosed in EP 238,216.

Formulation of Detergent Products

The detergent composition of the invention may be in any convenient form, e.g., a bar, a homogenous tablet, a tablet having two or more layers, a pouch having one or more compartments, a regular or compact powder, a granule, a paste, a gel, or a regular, compact or concentrated liquid.

Pouches can be configured as single or multicompartments. It can be of any form, shape and material which is suitable for hold the composition, e.g. without allowing the release of the composition to release of the composition from the pouch prior to water contact. The pouch is made from water soluble film which encloses an inner volume. Said inner volume can be divided into compartments of the pouch. Preferred films are polymeric materials preferably polymers which are formed into a film or sheet. Preferred polymers, copolymers or derivates thereof are selected polyacrylates, and water soluble acrylate copolymers, methyl cellulose, carboxy methyl cellulose, sodium dextrin, ethyl cellulose, hydroxyethyl cellulose, hydroxypropyl methyl cellulose, malto dextrin, poly methacrylates, most preferably polyvinyl alcohol copolymers and, hydroxypropyl methyl cellulose (HPMC). Preferably the level of polymer in the film for example PVA is at least about 60%. Preferred average molecular weight will typically be about 20,000 to about 150,000. Films can also be of blended compositions comprising hydrolytically degradable and water soluble polymer blends such as polylactide and polyvinyl alcohol (known under the Trade reference M8630 as sold by Mono-Sol LLC, Indiana, USA) plus plasticisers like glycerol, ethylene glycerol, propylene glycol, sorbitol and mixtures thereof. The pouches can comprise a solid laundry cleaning composition or part components and/or a liquid cleaning composition or part components separated by the water soluble film. The compartment for liquid components can be different in composition than compartments containing solids: US2009/0011970 A1.

Detergent ingredients can be separated physically from each other by compartments in water dissolvable pouches or in different layers of tablets. Thereby negative storage interaction between components can be avoided. Different dissolution profiles of each of the compartments can also give rise to delayed dissolution of selected components in the wash solution.

A liquid or gel detergent, which is not unit dosed, may be aqueous, typically containing at least 20% by weight and up to 95% water, such as up to about 70% water, up to about 65% water, up to about 55% water, up to about 45% water, up to about 35% water. Other types of liquids, including without limitation, alkanols, amines, diols, ethers and polyols may be included in an aqueous liquid or gel. An aqueous liquid or gel detergent may contain from 0-30% organic solvent.

A liquid or gel detergent may be non-aqueous.

Methods and Uses

In a first aspect, the present invention provides a detergent composition comprising a surfactant, a detergent builder and a DNase which has at least 80% identity, preferably at least 90% identity, more preferably at least 95% identity, and most preferably 100% identity to the amino acid sequence shown as amino acids 1 to 110 of SEQ ID NO: 1 or amino acids 1 to 109 of SEQ ID NO: 2; wherein the detergent composition is capable of reducing adhesion of bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis*, and *Stenotrophomonas* sp. to a surface, or releasing the bacteria from a surface to which they adhere.

In an embodiment, the detergent composition also comprises a surfactant; and optionally also a detergent builder or co-builder. Preferably, the surface is a textile surface and the aqueous composition is a laundry detergent composition. The textile surface may be the surface of any textile item, such as an item made of cotton or a synthetic material, for example a piece of sportswear, a T-shirt, or another piece of clothing which is exposed to sweat when used. The textile surface may also be the surface of bedding, bed linen or towels.

In an embodiment, the detergent composition does not contain an effective amount of a bleaching system.

In an embodiment, the detergent composition is capable of reducing malodor from wet laundry, which has been washed at 10-40° C. (preferably 10-35° C. or 10-30° C.).

In an embodiment, the detergent composition is capable of reducing malodor from wet laundry, which has been washed at 10-40° C. (preferably 10-35° C. or 10-30° C.) and incubated at 20° C. for 12 hours.

In another aspect, the invention provides a method for reducing adhesion of bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis, Stenotrophomonas* sp. to a surface, or releasing the bacteria from a surface to which they adhere, comprising contacting the bacteria with an aqueous composition comprising a DNase which has at least 80% identity, preferably at least 90% identity, more preferably at least 95% identity, and most preferably 100% identity to the amino acid sequence shown as amino acids 27 to 136 of SEQ ID NO: 1 or amino acids 34 to 142 of SEQ ID NO: 2.

Preferably, the aqueous composition comprises at least 1 mg/I of a DNase.

In an embodiment, the aqueous composition also comprises a surfactant; and optionally also a detergent builder or co-builder. Preferably, the surface is a textile surface and the aqueous composition is a laundry detergent composition. The textile surface may be the surface of any textile item, such as an item made of cotton or a synthetic material, for example a piece of sportswear, a T-shirt, or another piece of clothing which is exposed to sweat when used. The textile surface may also be the surface of bedding, bed linen or towels.

In an embodiment, the bacterial adhesion is reduced by at least 50%, or at least 50% of the bacteria are released from the surface.

In an embodiment, the method is capable of reducing malodor from wet laundry, which has been washed at 10-40° C. (preferably 10-35° C. or 10-30° C.) and incubated at 20° C. for 12 hours.

In another aspect, the invention provides a (laundry) composition comprising water; textile items; bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis, Stenotrophomonas* sp.; and a DNase. Preferably, the composition comprises at least 1 mg/l of a DNase as described above. The textile item may be an item made of cotton or a synthetic material, for example a piece of sportswear, a T-shirt, or another piece of clothing which is exposed to sweat when used. The textile item may also be bedding, bed linen or towels.

The invention also provides for use of the methods and compositions above for reducing adhesion of bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis, Stenotrophomonas* sp. to a surface, or releasing the bacteria from a surface to which they adhere.

The invention also provides for use of the methods and compositions above for reducing malodor from laundry which has been washed at 10-40° C. (preferably 10-35° C. or 10-30° C.) and subsequently incubated at 20° C. for 12 hours; or for reducing malodor from clothes which have been exposed to direct body contact during normal use, washed at 10-40° C. (preferably 10-35° C. or 10-30° C.), and subsequently again exposed to direct body contact during normal use (preferably for at least 10 hours).

The methods according to the invention may be carried out at a temperature between 5 and 70 degrees Celsius, preferably between 10 and 60 degrees Celsius, more preferably between 10 and 50 degrees Celsius, even more preferably between 10 and 40 degrees Celsius, even more preferably between 10 and 35 degrees Celsius, most preferably between 10 and 30 degrees Celsius, and in particular between 15 and 30 degrees Celsius.

The methods of the invention may employ a treatment time of from 10 minutes to 120 minutes, preferably from 10 minutes to 90 minutes, more preferably from 10 minutes to 60 minutes, more preferably from 15 minutes to 45 minutes, and most preferably from 15 minutes to 30 minutes.

The methods of the invention may be carried out at pH 3 to pH 11, preferably at pH 5 to pH 10, more preferably at pH 7 to pH 9. Most preferably, the methods of the invention are carried out at the pH or temperature optimum of the DNase+/− one pH unit.

The invention is summarized in the following paragraphs:

1. A detergent composition comprising
   a. One or more anionic surfactants;
   b. An enzyme selected from the group consisting of: a protease, a lipase, a cutinase, an amylase, a carbohydrase, a cellulase, a pectinase, a mannanase, an arabinase, a galactanase, a xylanase, and an oxidase; and
   c. a deoxyribonuclease (DNase).
2. Composition according to paragraph 1, wherein the anionic surfactant is selected from the group consistint of: linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis (sulfates), hydroxyalkanesulfonates and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES), secondary alkanesulfonates (SAS), paraffin sulfonates (PS), ester sulfonates, sulfonated fatty acid glycerol esters, alpha-sulfo fatty acid methyl esters (alpha-SFMe or SES), methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid or soap.
3. Composition according to any of the preceding paragraphs, wherein the amount of anioinic surfactant is in the range of 1 to 40%, in the range of 5 to 30% or in the range of 10 to 20%.
4. Composition according to any of the preceding paragraphs, wherein the amount of detergent builder or co-builder is in the range of 0 to 65%, in the range of 40-65% or in the range of 40 to 65%.
5. Composition according to any of the preceding paragraphs, wherein the composition comprises 10-40 w/w % of a surfactant, 4-50 w/w % of a builder and 0-5 w/w % of a polymer and optionally a filler, solvents and an enzyme stabilizer.
6. Composition according to any of the preceding paragraphs, wherein the DNase is obtainable from a bacterium.
7. Composition according to any of the preceding paragraphs, wherein the DNase is obtainable from *Bacillus*.
8. Composition according to any of the preceding paragraphs, wherein the DNase has at least 80% identity to the amino acid sequence shown as amino acids 1 to 110 of SEQ ID NO: 1 or amino acids 1 to 109 of SEQ ID NO: 2.
9. Composition according to any of the preceding paragraphs, wherein the DNase has at least 85% identity to the amino acid sequence shown as amino acids 1 to 110 of SEQ ID NO: 1 or amino acids 1 to 109 of SEQ ID NO: 2.
10. Composition according to any of the preceding paragraphs, wherein the DNase has at least 90% identity to the amino acid sequence shown as amino acids 1 to 110 of SEQ ID NO: 1 or amino acids 1 to 109 of SEQ ID NO: 2.
11. Composition according to any of the preceding paragraphs, wherein the DNase has at least 95% identity to the amino acid sequence shown as amino acids 1 to 110 of SEQ ID NO: 1 or amino acids 1 to 109 of SEQ ID NO: 2.
12. Composition according to any of the preceding paragraphs, wherein the DNase has at least 97% identity to the amino acid sequence shown as amino acids 1 to 110 of SEQ ID NO: 1 or amino acids 1 to 109 of SEQ ID NO: 2.
13. Composition according to any of the preceding paragraphs, wherein the DNase has at least 98% identity to the amino acid sequence shown as amino acids 1 to 110 of SEQ ID NO: 1 or amino acids 1 to 109 of SEQ ID NO: 2.
14. Composition according to any of the preceding paragraphs, wherein the DNase has at least 99% identity to the amino acid sequence shown as amino acids 1 to 110 of SEQ ID NO: 1 or amino acids 1 to 109 of SEQ ID NO: 2.
15. Composition according to any of the preceding paragraphs, wherein the detergent composition is capable of reducing adhesion of bacteria selected from the group consisting of *Acinetobacter* sp., *Aeromicrobium* sp.,

*Brevundimonas* sp., *Microbacterium* sp., *Micrococcus luteus, Pseudomonas* sp., *Staphylococcus epidermidis*, and *Stenotrophomonas* sp. to a surface, or releasing the bacteria from a surface to which they adhere.

16. Composition according to any of the preceding paragraphs, wherein the surface is a textile surface.
17. Composition according to any of the preceding paragraphs, wherein the composition is capable of reducing malodor from wet and/or dry laundry.
18. Composition according to any of the preceding paragraphs, wherein the composition is capable of reducing E-2-nonenal from wet and/or dry laundry.
19. Composition according to any of the preceding paragraphs, wherein the composition is a bar, a homogenous tablet, a tablet having two or more layers, a pouch having one or more compartments, a regular or compact powder, a granule, a paste, a gel, or a regular, compact or concentrated liquid.
20. Composition according to any of the preceding paragraphs, wherein the composition is a liquid detergent, a powder detergent or granule detergent.
21. A washing method for textile comprising:
    a. exposing a textile to a wash liquor comprising a DNase or a detergent composition according to any of paragraphs 1-20,
    b. completing at least one wash cycle; and
    c. optionally rinsing the textile.
22. Method according to paragraph 21, wherein the pH of the wash liquor is in the range of 7 to 10, preferably 7 to 9 such as 7.5.
23. Method according to any of the preceding method paragraphs, wherein the temperature of the wash liquor is in the range of 5° C. to 95° C., or in the range of 10° C. to 80° C., or in the range of 10° C. to 70° C., or in the range of 10° C. to 60° C., or in the range of 10° C. to 50° C., or in the range of 15° C. to 40° C., or in the range of 20° C. to 30° C.
24. Method according to any of the preceding method paragraphs, wherein the temperature of the wash liquor is 30° C.
25. Method according to any of the preceding method paragraphs, wherein the textile is exposed to a wash liquor during a first and optionally a second and third wash cycle.
26. Method according to any of the preceding method paragraphs, wherein the textile is rinsed after being exposed to the wash liquor.
27. Method according to any of the preceding method paragraphs, wherein a conditioner is used for the rinsing of the textile.
28. Method according to any of the preceding method paragraphs, wherein the malodor of wet and/or dry laundry textile is reduced.
29. Method according to any of the preceding method paragraphs, wherein the amount of E-2-nonenal on wet and/or dry laundry textile is reduced.
30. Method according to any of the preceding method paragraphs, wherein the whiteness of the textile is maintained or improved.
31. Method according to any of the preceding method paragraphs, wherein the redeposition of soil is reduced.
32. Textile washed according to the method of any of paragraphs 21-31.
33. Use of a deoxyribonuclease (DNase) for reducing malodor from laundry and/or textile.
34. Use of a DNase according to any of the preceding paragraphs for reducing malodor from clothes which have been exposed to direct body contact during normal use, washed at 10-40° C., and subsequently again exposed to direct body contact during normal use.
35. Use according to paragraph 31 for reducing the amount of E-2-nonenal on a textile.
36. Use according to any of the preceding use paragraphs, wherein the amount of E-2-nonenal present on a textile is reduced to below 80% of the amount of E-2-nonenal present on the textile before wash.
37. Use according to any of the preceding use paragraphs, wherein the amount of E-2-nonenal present on a textile is reduced to below 70%, below 60%, below 50%, below 40%, below 30%, below 20%, below 10% or below 5% of the amount of E-2-nonenal present on the textile before wash or is reduced.
38. Use of DNase for maintaining or improving the whiteness of a textile.
39. Use of DNase for reducing redeposition of soil during a wash cycle.
40. Use according to any of the preceding use paragraphs, wherein the DNase is obtainable from a bacterium.
41. Use according to any of the preceding use paragraphs, wherein the DNase is obtainable from *Bacillus*.
42. Use according to any of the preceding use paragraphs, wherein the DNase has at least 80% identity to the amino acid sequence shown as amino acids 1 to 110 of SEQ ID NO: 1 or amino acids 1 to 109 of SEQ ID NO: 2.
43. Use according to any of the preceding use paragraphs, wherein the DNase has at least 85% identity to the amino acid sequence shown as amino acids 1 to 110 of SEQ ID NO: 1 or amino acids 1 to 109 of SEQ ID NO: 2.
44. Use according to any of the preceding use paragraphs, wherein the DNase has at least 90% identity to the amino acid sequence shown as amino acids 1 to 110 of SEQ ID NO: 1 or amino acids 1 to 109 of SEQ ID NO: 2.
45. Use according to any of the preceding use paragraphs, wherein the DNase has at least 95% identity to the amino acid sequence shown as amino acids 1 to 110 of SEQ ID NO: 1 or amino acids 1 to 109 of SEQ ID NO: 2.
46. Use according to any of the preceding use paragraphs, wherein the DNase has at least 97% identity to the amino acid sequence shown as amino acids 1 to 110 of SEQ ID NO: 1 or amino acids 1 to 109 of SEQ ID NO: 2.
47. Use according to any of the preceding use paragraphs, wherein the DNase has at least 98% identity to the amino acid sequence shown as amino acids 1 to 110 of SEQ ID NO: 1 or amino acids 1 to 109 of SEQ ID NO: 2.
48. Use according to any of the preceding use paragraphs, wherein the DNase has at least 99% identity to the amino acid sequence shown as amino acids 1 to 110 of SEQ ID NO: 1 or amino acids 1 to 109 of SEQ ID NO: 2.

And the invention is also summarized in the below paragraphs:

1a. A detergent composition comprising a surfactant, a detergent builder and a DNase which has at least 80% identity, preferably at least 90% identity, more preferably at least 95% identity, and most preferably 100% identity to the amino acid sequence shown as amino acids 27 to 136 of SEQ ID NO: 1 or amino acids 34 to 142 of SEQ ID NO: 2; wherein the detergent composition is capable of reducing adhesion of bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis*, and *Stenotrophomonas* sp. to a surface, or releasing the bacteria from a surface to which they adhere.

2a. The composition of paragraph 1a, which is a laundry detergent composition, and wherein the surface is a textile surface.

3a. The composition of paragraphs 1a or 2a, which is capable of reducing malodor from wet laundry which has been washed at 10-40° C. and subsequently incubated at 20° C. for 12 hours.

4a. A method for reducing adhesion of bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis, Stenotrophomonas* sp. to a surface, or releasing the bacteria from a surface to which they adhere, comprising contacting the bacteria with an aqueous composition comprising a DNase which has at least 80% identity, preferably at least 90% identity, more preferably at least 95% identity, and most preferably 100% identity to the amino acid sequence shown as amino acids 27 to 136 of SEQ ID NO: 1 or amino acids 34 to 142 of SEQ ID NO: 2.

5a. The method of paragraph 4a, wherein the aqueous composition also comprises a surfactant.

6a. The method of paragraphs 4a or 5a, wherein the surface is a textile surface and the aqueous composition is a laundry detergent composition.

7a. The method of any of paragraphs 4a-6a, wherein the temperature of the aqueous composition is 10-40° C.

8a. The method of any of paragraphs 4a-7a, which reduces malodor from wet laundry which has been washed at 10-40° C. and subsequently incubated at 20° C. for 12 hours.

9a. The method of any of paragraphs 4a-8a, wherein the adhesion is reduced by at least 50%, or at least 50% of the bacteria are released from the surface.

10a. A aqueous composition comprising water; surfactant; textile items or dishware; bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis*, and *Stenotrophomonas* sp.; and a DNase which has at least 80% identity, preferably at least 90% identity, more preferably at least 95% identity, and most preferably 100% identity to the amino acid sequence shown as amino acids 27 to 136 of SEQ ID NO: 1 or amino acids 34 to 142 of SEQ ID NO: 2.

11a. Use of a DNase for reducing adhesion of bacteria selected from the group consisting of *Acinetobacter* sp., *Aeromicrobium* sp., *Brevundimonas* sp., *Microbacterium* sp., *Micrococcus luteus, Pseudomonas* sp., *Staphylococcus epidermidis*, and *Stenotrophomonas* sp. to a surface, or releasing the bacteria from a surface to which they adhere.

12a. Use of a DNase for reducing malodor from laundry which has been washed at 10-40° C. and subsequently incubated at 20° C. for 12 hours.

13a. Use of a DNase for reducing malodor from clothes which have been exposed to direct body contact during normal use, washed at 10-40° C., and subsequently again exposed to direct body contact during normal use.

The present invention is further described by the following examples which should not be construed as limiting the scope of the invention.

EXAMPLES

Chemicals used as buffers and substrates were commercial products of at least reagent grade. The *Bacillus subtilis* DNase used in the following Example has an amino acid sequence shown as SEQ ID NO: 1, and the *Bacillus licheniformis* DNase has an amino acid sequence shown as SEQ ID NO: 2.

Assay I

Determination of DNase Activity—

DNase activity, as defined in the present invention, is a deoxyribonuclease activity capable of degrading a deoxyribonucleic acid (DNA), such as the enzymatic activity described in EC 3.1.21.- or EC 3.1.22.-, preferably EC 3.1.21.-, and most preferably EC 3.1.21.1; based on the recommendations of the Nomenclature Committee of the International Union of Biochemistry and Molecular Biology (IUBMB).

Several assays for determining DNase activity are commercially available, or have been published in the literature, such as Tolun and Myers "A real-time DNase assay (ReDA) based on PicoGreen fluorescence", Nucleic Acids Research (2003), vol. 31, no. 18, e111; or Sinicropi et al. "Colorimetric determination of DNase I activity with a DNA-methyl green substrate", Analytical Biochemistry (1994), 222(2), pp. 351-8.

Assay II

Analysis of E-2-Nonenal on Textile Using an Electronic Nose

One way of testing for the presence of malodor on textiles is by using E-2-Nonenal as a marker for the malodor, as this compound contributes to the malodor on laundry.

Add a solution of E-2-nonenal to a 5 cm×5 cm textile swatch and place the swatch in a 20 mL glass vial for GC analysis and cap the vial. Analyze 5 mL headspace from the capped vials in a Heracles II Electronic nose from Alpha M.O.S., France (double column gas chromatograph with 2 FIDs, column 1: MXT5 and column 2: MXT1701) after 20 minutes incubation at 40° C.

Example 1

Reducing Adhesion of Laundry Specific Bacteria Using a DNase

Isolating Laundry Specific Bacterial Strains

One of the aims of the present study was to investigate the bacterial diversity in laundry after washing at 15, 40 and 60° C., respectively.

The study was conducted on laundry collected from Danish households. For each wash, 20 g of laundry items (tea towel, towel, dish cloth, bib, T-shirt armpit, T-shirt collar, socks) in the range 4:3:2:2:1:1:1 was used. Washing was performed in a Laundr-O-Meter (LOM) at 15, 40 and 60° C. For washing at 15 and 40° C., Ariel Sensitive White & Color was used, whereas WFK IEC-A* model detergent was used for washing at 60° C. Ariel Sensitive White & Color was prepared by weighing out 5.1 g and adding tap water up to 1000 ml followed by stirring for 5 minutes. WFK IEC-A* model detergent (which is available from WFK Testgewebe GmbH) was prepared by weighing out 5 g and adding tap water up to 1300 ml followed by stirring for 15 min. Washing was performed for 1 hour at 15, 40 and 60° C., respectively, followed by 2 times rinsing for 20 min at 15° C.

Laundry was sampled immediately after washing at 15, 40 and 60° C., respectively. Twenty grams of laundry was added 0.9% (w/v) NaCl (1.06404; Merck, Damstadt, Germany) with 0.5% (w/w) tween 80 to yield a 1:10 dilution in stomacher bag. The mixture was homogenized using a Stomacher for 2 minutes at medium speed. After homogenization, ten-fold dilutions were prepared in 0.9% (w/v)

NaCl. Bacteria were enumerated on Tryptone Soya Agar (CM0129, Oxoid, Basingstoke, Hampshire, UK) incubated aerobically at 30° C. for 5-7 days. To suppress growth of yeast and moulds, 0.2% sorbic acid (359769, Sigma) and 0.1% cycloheximide (18079; Sigma) were added. Twenty-four bacterial and fungal colonies were selected from countable plates and purified by restreaking twice on TSA. For long time storage, purified isolates were stored at −80° C. in TSB containing 20% (w/v) glycerol (49779; Sigma).

Contacting Laundry Specific Bacteria with DNase to Reduce Adhesion

Eight strains of laundry-relevant bacteria (*Acinetobacter* sp., *Aeromicrobium* sp., *Brevundimonas* sp., *Microbacterium* sp., *Micrococcus luteus, Pseudomonas* sp., *Staphylococcus epidermidis* and *Stenotrophomonas* sp.) were used in the present study. The selected strains gave rise to very unpleasant malodor.

For long term storage, bacterial strains were maintained at −80° C. in Tryptone Soya Broth (TSB) (pH 7.3) (CM0129, Oxoid Ltd, Basingstoke, UK), to which 20% (v/v) glycerol (Merck, Darmstadt, Germany) was added. Bacterial cultures were pre-grown on Tryptone Soya Agar (TSA) (pH 7.3) for 3-5 days at 30° C. From a single colony, a loop-full was transferred to a test tube containing 10 ml TSB and incubated for 1 day at 30° C. with shaking (240 rpm). After propagation, bacterial cells were used to investigate the biofilm prevention and removal properties of *Bacillus substilis* DNase (SEQ ID NO:1) and *Bacillus licheniformis* DNase (SEQ ID NO:2).

In order to investigate biofilm prevention, bacterial cells were diluted 1000 times in TSB added 0, 0.5, 1, 2, 4, 8, 16, 32, 64, 128 and 256 ppm DNase. One hundred µl was inoculated into a 96-well polystyrene plate (flat bottom) (161093; Nunc, Roskilde, Denmark) and incubated for 3 days at 30° C. After incubation, growth was determined by measurement of the optical density at 600 nm using a Spectramax Plus 384 reader (Molecular Devices, Sunnyvale, Calif., USA). Adhesion/biofilm prevention was measured by removing non-adherent cells by washing two times with 0.9% (w/v) NaCl (Merck). To measure adherence, 200 µl of 0.1% (w/v) crystal violet (C0775; Sigma-Aldrich, St. Louis, Mo., USA) was added and left for 15 min at room temperature. The wells were washed two times with 0.9% (w/v) NaCl, and bound crystal violet was eluted by the addition of 200 µl 96% (w/v) ethanol (201145; Kemetyl, Køige, Denmark) and determined by measurement at 595 nm.

In order to investigate biofilm removal, bacterial cells were diluted 100 times in TSB and 100 µl was added to microtiter plate. Bacterial cells were incubated for 3 days at 30° C. to adhere to the surface and produce a uniform biofilm. Cells which did not adhere to the surface of the microtiter plate were gently washed off, and the remaining biofilm producing cells were treated for 1 hour at 30° C. with DNase (30 and 100 ppm, respectively) in an aqueous detergent solution, prepared by adding 3.33 g/l in water of a model A containing 12% LAS, 11% AEO Biosoft N25-7 (NI), 7% AEOS (SLES), 6% MPG, 3% ethanol, 3% TEA (triethanolamine), 2.75% cocoa soap, 2.75% soya soap, 2% glycerol, 2% sodium hydroxide, 2% sodium citrate, 1% sodium formiate, 0.2% DTMPA, 0.2% PCA and 40.63% ion changed water (all percentages are w/w).

TABLE 1

Table 1 shows the lowest concentration at which prevention of bacterial attachment was observed.

| Strain | *Bacillus subtilis* DNase | *B. licheniformis* DNase |
|---|---|---|
| *Acinetobacter* sp. | 0.5 ppm | 0.5 |
| *Aeromicrobium* sp. | 4 | 0.5 |
| *Brevundimonas* sp. | 64 | 128 |
| *Microbacterium* sp. | 16 | — |
| *Micrococcus luteus* | 16 | 32 |
| *Pseudomonas* sp. | 8 | — |
| *Staphylococcus epidermidis* | 4 | 64 |

TABLE 2

Biofilm removal by *Bacillus subtilis* DNase and *Bacillus licheniformis* DNase. +/− in Table 2: biofilm removal/no biofilm removal

| | *Bacillus subtilis* DNase | | *B. licheniformis* DNase | |
|---|---|---|---|---|
| Strain | 30 ppm | 100 ppm | 30 ppm | 100 ppm |
| *Acinetobacter* sp. | − | − | + | + |
| *Aeromicrobium* sp. | − | − | − | − |
| *Brevundimonas* sp. | + | + | + | + |
| *Microbacterium* sp. | − | + | − | + |
| *Micrococcus luteus* | + | + | − | − |
| *Pseudomonas* sp. | + | + | − | − |
| *Staphylococcus epidermidis* | + | + | + | + |
| *Stenotrophomonas* sp. | + | + | − | + |

The present study shows that *Bacillus subtilis* DNase and *Bacillus licheniformis* DNase decreases the adhesion properties of *Acinetobacter* sp., *Aeromicrobium* sp., *Brevundimonas* sp., *Microbacterium* sp., *Micrococcus luteus, Pseudomonas* sp., *Staphylococcus epidermidis, Stenotrophomonas* sp. found in washed laundry, where they produce malodor when the textiles are used again after being washed.

Most important, inhibition of adhesion properties will prevent transfer of these bacteria between different textile items during the washing process and thus limit the occurrence of these bacteria. Furthermore, inhibition of adhesion properties will minimize the risk of growth of these bacteria inside the washing machine. Growth of bacteria inside the washing machine may cause malodor from the washing machine. Furthermore, detached bacteria may be transferred to textiles during the washing process and later cause malodor from textiles when they are used after the washing process.

Example 2

Performance of *B. licheniformis* DNase (SEQ ID NO:2) in Model Detergents and Commercial Detergents One strain of *Brevundimonas* sp. isolated from laundry (see Example 1) was used in the present example.

For long term storage, *Brevundimonas* sp. was maintained at −80° C. in Tryptone Soya Broth (TSB) (pH 7.3) (CM0129; Oxoid Ltd, Basingstoke, UK), to which 20% (v/v) glycerol (Merck, Darmstadt, Germany) was added. *Brevundimonas* sp. was pre-grown on Tryptone Soya Agar (TSA) (pH 7.3) (CM0131; Oxoid Ltd, Basingstoke, UK) for 2-5 days at 30° C. From a single colony, a loop-full was transferred to 10 mL of TSB and incubated for 1 day at 30° C. with shaking (240 rpm). After propagation, *Brevundimonas* sp. was pelleted by centrifugation (Sigma Laboratory Centrifuge 6K15) (3000 g at 21° C. in 7 min) and resuspended in 10 mL of TSB diluted twice with water. Optical density (OD) at 600 nm was measured using a spectophometer (POLARstar Omega (BMG Labtech, Ortenberg, Germany). Fresh TSB diluted twice with water was inoculated to an $OD_{600nm}$ of 0.03, and 1.6 mL was added into each well of a 12-well polystyrene flat-bottom microplate (3512; Corning Incorporated, Corning, N.Y., USA) in which a round swatch (diameter 2 cm) of sterile Polyester WFK30A was placed. After incubation (24 h at 15° C. with shaking (100 rpm), swatches were washed twice with 0.9% (w/v) NaCl. Five washed swatches with *Brevundimonas* sp. was mixed with five sterile Polyester WFK30A swatches in a 50 mL test tube and added 10 mL of detergent wash solution containing 0.7 g/L soil (Pigmentschmutz, 09V, wfk, Krefeld, Germany) and *Bacillus licheniformis* DNase (5 ppm). Test tubes were placed in a Stuart rotator for 1 hour at 30° C. Swatches were rinsed twice with tap water and dried on filter paper over night. As controls, washes without addition of *B. licheniformis* DNase were made in parallel. Remission (L values) was measured using a Color Eye (Macbeth Color Eye 7000 reflectance spectrophotometer). The measurements were made without UV in the incident light and the L value from the CIE Lab color space was extracted.

In order to investigate the deep cleaning effects of DNase in various detergents, both model and commercial detergents (liquids and powders) from different regions were selected.

Concerning liquids, following detergents were used: model detergent A containing containing 12% LAS, 11% AEO Biosoft N25-7 (NI), 7% AEOS (SLES), 6% MPG (monopropylene glycol), 3% ethanol, 3% TEA, 2.75% cocoa soap, 2.75% soya soap, 2% glycerol, 2% sodium hydroxide, 2% sodium citrate, 1% sodium formiate, 0.2% DTMPA 0.2% PCA and 40.63% ion changed water (all percentages are w/w) (EU, 3.3 g/L), TIDE Original (US, 3.2 g/L), Ariel Actilift (EU, 6.9 g/L), OMO Small and Mighty (EU, 4 g/L), PERSIL™ Gel Sensitive (EU, 7.2 g/L) and Blue Moon (Asia, 1.6 g/L).

Concerning powders, following detergents were used: Model detergent T containing 11% LAS, 2% AS/AEOS, 2% soap, 3% AEO, 15.15% sodium carbonate, 3% sodium silicate, 18.75% zeolite, 0.15% chelant, 2% sodium citrate, 1.65% AA/MA copolymer, 2.5% CMC 0.5% SRP, 36.% sodium sulphate and 2% foam controller (all percentages are w/w) (EU, 5.3 g/L), Model detergent X containing 16.5% LAS, 15% zeolite, 12% sodium disilicate, 20% sodium carbonate, 1% sokalan, 35.5% sodium sulphate (all percentages are w/w) (Asia, 1.8 g/L), Ariel (EU, 5.3 g/L) and PERSIL™ Megaperls (EU, 4.0 g/L).

For EU detergents, water with hardness 15° dH (Ca:Mg:$NaHCO_3$4:1:1.5) was used. For US detergents, water with hardness 6° dH (Ca:Mg:$NaHCO_3$ 2:1:1.5) was used. For Asian detergents, water with hardness 14° dH (Ca:Mg:$NaHCO_3$2:1:1.5) was used.

TABLE 3

Deep cleaning effects of *Bacillus licheniformis* DNase.

| Detergent | Remission (ΔL) |
|---|---|
| Liquids: | |
| Model detergent A | 8.1 |
| TIDE Original | 4.7 |
| Ariel Actilift | 5.9 |
| OMO Small and Mighty | 5.6 |
| PERSIL ™ Gel Sensitive | 5.2 |
| Blue Moon | 9.0 |

TABLE 3-continued

Deep cleaning effects of *Bacillus licheniformis* DNase.

| Detergent | Remission (ΔL) |
|---|---|
| Powders: | |
| Model detergent T | 6.6 |
| Model detergent X | 6.2 |
| Ariel Actilift | 8.3 |
| PERSIL ™ Megaperls | 5.4 |

The present example shows that *B. licheniformis* DNase prevents soil deposition (anti-redeposition) to polyester swatches pre-grown with bacteria. The prevention of soil deposition was both observed in liquid detergents with pH 8.0, but also in powder detergents with pH 10. The observed effect is due to the deep cleaning effects of *B. licheniformis* DNase. Most importantly, the present example shows that *B. licheniformis* DNase will prevent transfer of soil between different textile items during the washing process and thus enabling that dirty laundry can be washed with less dirty laundry.

Example 3

DNA/DNase/Malodor

This example shows that the presence of DNA on textile makes compounds like E-2-Nonenal, a malodorous compound found in laundry, stick better to the textile even after a detergent wash.

Using a DNase in the wash reduces the presence of DNA on the textile, and thereby also the presence of the E-2-Nonenal, and thereby decreasing malodor in the laundry.

Twelve 5 cm×5 cm polyester textile (wfk30A) swatches were placed in separate petri dishes, and 500 μL of MilliQ water was applied to 4 of the swatches while 500 μL of a solution of 0.05 mg/mL DNA from salmon testes dissolved in MilliQ water was applied to the remaining 8 swatches.

The 12 swatches were left to dry overnight at room temperature. 450 μL of 10 mM E-2-Nonenal dissolved in water was applied to all of the dry swatches, and they were left to dry for 1 hour under maximum flow in a LAF bench. The dry swatches were then placed in three 50 mL Falcon tubes together with each 20 mL of wash liquor made from MilliQ water and a liquid detergent (Model detergent A from example 1) in a concentration of 3.33 g/L, and to tube number three 30 ppm of DNase (NucB from *B. subtilis*) was added, all as described in Table 4.

In tube number 1, four swatches were placed with E-2-Nonenal and no DNA, and in each of tubes number 2 and 3 was placed four swatches with both E-2-Nonenal and DNA. The tubes were closed with a lid and mounted in a Mini-Laundr-O-Meter (a Stuart Tube Rotator SB3); the swatches were then washed at 30° C. for 60 minutes at 20 rpm.

After wash, the wash liquor was discarded and the swatches were rinsed 2 times with 15 mL MilliQ water. Each swatch was placed in a 20 mL glass vial for GC analysis and capped. The capped vials were analyzed in a Heracles II Electronic nose from Alpha M.O.S., France (double column gas chromatograph with 2 FIDs, column 1: MXT5 and column 2: MXT1701) where 5 mL of the headspace from each vial was analyzed after 20 minutes incubation at 40° C. The areas of the E-2-Nonenal peaks in the resulting chromatograms, for column 1 and 2 separately, were averaged for the swatches from the three tubes and can be seen in Table 4.

TABLE 4

| Tube | DNA | Nonenal | Washed with DNase | E-2-Nonenal average peak area (column 1) | E-2-Nonenal average peak area (column 2) |
|---|---|---|---|---|---|
| 1 | 0 μg/cm2 | 450 μL of 10 mM | 0 ppm | 11765 | 13392 |
| 2 | 1.0 μg/cm2 | 450 μL of 10 mM | 0 ppm | 699302 | 730078 |
| 3 | 1.0 μg/cm2 | 450 μL of 10 mM | 30 ppm | 72783 | 79228 |

The results in Table 4 show that the presence of DNA on the textile swatches makes the E-2-Nonenal stick better to the textile so more E-2-Nonenal is present on the textile after wash. In tube 2 the average peak area for E-2-Nonenal present on swatches with DNA is up to 59 times higher than the average peak area for E-2-Nonenal present on swatches without DNA (tube 1) showing that the presence of DNA on textile increases the malodor.

The results also show that adding DNase to the wash can decrease the amount of E-2-Nonenal sticking to the textile after wash thereby decreasing the malodor after wash.

In tube 3 the average peak area for E-2-Nonenal present on swatches with DNA decreased more than 9 times due to the addition of DNase in the wash compared to the average peak area for E-2-Nonenal present on swatches with DNA in tube 2 showing that the presence of DNase in wash decreases the malodor on textile.

Example 4

Example 4a

Preparation of DNA Stained Textile

To prepare DNA stained textile swatches, called "DNA swatches", dissolve 5.0 mg/mL DNA in sterile MilliQ water and place in fridge at 5° C. overnight to let the DNA dissolve. Make dilutions of the DNA solution to e.g. 0.25, 0.5 or 1.0 mg/mL in sterile MilliQ water. Place up to 6 round textile swatches with a 2 cm diameter in a sterile petri dish and apply 100 μL DNA solution of the chosen concentration to each textile swatch and leave them in the petri dish without lid overnight or until dry. To re-apply DNA to washed DNA swatches wait until the washed DNA swatches are dry and apply 100 μL DNA solution of the chosen concentration to each textile swatch and leave them in the petri dish without lid overnight or until dry.

Example 4b

Assay III: Multicyclus Wash DNA/Dirt

One way of testing DNA buildup on textiles and DNA redeposition effects on textiles in wash is to wash DNA swatches together with clean textile swatches, called "tracer swatches", in multiple consecutive washes with detergent and soil where DNA is re-applied to the DNA swatches between each wash to simulate wear between washes.

Prepare 1 L 15° dH water by pipetting 3.00 mL of 0.713 mol/L CaCl2, 1.50 mL of 0.357 mol/L and 0.3371 g of NaHCO3 into a 1 L measuring cylinder, fill up to 1 L with MilliQ water and stir to dissolve. Weigh of 3.33 g of model detergent A and dissolve in the water. Weigh of 0.70 g Pigment Soil acc. to ILG 09V from wfk Testgewebe GmbH, Germany, and dissolve in the water with detergent, called a dirty detergent solution. Place 5 DNA swatches and 5 tracer swatches in each 50 mL plastic beaker (Falcon or NUNC centrifuge tube). Add 10 mL of the dirty detergent solution to each beaker. Put a lid on all the beakers, shake them well to ensure a good distribution of swatches. Mount the beakers in a Mini-Laundr-O-Meter (a Stuart Tube Rotator SB3) and wash at 30° C. for 60 minutes at 20 rpm. After wash the rotator is placed at room temperature while swatches from one beaker at a time are rinsed with 15° dH water and placed back into the rotator. Rinse each beaker 2 times in 20 mL 15° dH water. After the last rinse the swatches are left to dry on filter paper either overnight or until dry. When dry reapply DNA to the DNA swatches as described above. Repeat the wash and DNA reapplication until the swatches have been washed a total of 5 times or until sufficient differences are visible after wash. The same tracer swatches are used throughout the experiment to show the buildup of DNA transferred in the washes. DNA which is washed of one textile swatch can stick to clean textile and the presence of DNA on textile makes dirt stick better to the textile even after detergent wash. After the last wash measure the reflectance of all the textile swatches in ColorEye or DigiEye, the more DNA on the textile swatches the more deposited soil.

Example 4c

Multicyclus Wash DNA/DNase/Dirt

This example shows that DNA which is washed of one textile swatch can stick to clean textile present during the wash and that the presence of DNA on textile makes dirt (pigment soil) stick better to the textile even after detergent wash. The example also shows that washing with a detergent containing DNase significantly decreased the amount of DNA present on the DNA swatches and thus decreased the amount of dirt sticking to the DNA swatches. The experiment also shows that washing with detergent containing DNase significantly decreased the amount of DNA that transferred from the DNA swatches to the tracer swatches thus decreasing the amount of dirt sticking to the tracer swatches (anti-redeposition).

Preparation of DNA swatches and the Multicyclus wash DNA/dirt assay was done as described above. Deoxyribonucleic acid sodium from Salmon testes D1626 from Sigma Aldrich was used as DNA source. Prewashed Polyester WFK 30A from wfk Testgewebe GmbH, Germany was used as textile. The DNase washes were done with 0.5 ppm of DNase (NucB DNase from *B. licheniformis*) in the dirty detergent solution. All swatches are at all times handled wearing gloves or using forceps. The experimental setup was made as described in table 5 below:

| Beaker no. | DNA swatches | Tracer swatches | DNase | Dirty detergent solution |
|---|---|---|---|---|
| 1 | 5 pieces with 1.0 mg/ml DNA | 5 pieces | — | + |
| 2 | 5 pieces with 1.0 mg/ml DNA | 5 pieces | 0.5 ppm | + |
| 3 | 5 pieces with 0.5 mg/ml DNA | 5 pieces | — | + |
| 4 | 5 pieces with 0.5 mg/ml DNA | 5 pieces | 0.5 ppm | + |
| 5 | 5 pieces with no DNA | 5 pieces | — | + |
| 6 | 5 pieces with no DNA | 5 pieces | 0.5 ppm | + |

A total of 4 washes were made for the 6 beakers before all swatches were measured in DigiEye (DigiEye Imaging System, Light Source D65, Diffuse Illumination) where the Tristimulus Y values, called Y values, were recorded. In the table below the averages for the Y values of the swatches are noted. The higher the value the whiter the swatch as seen in table 6 below:

| Beaker no. | Swatch type | Conc. of DNA swatches in beaker (mg/mL)* | DNase in wash | Average Y value | Standard deviation | Delta Y value (**) | T-test (***) |
|---|---|---|---|---|---|---|---|
| 1 | DNA | 0.5 | — | 64.5 | 2.24 | 13.6 | 0.0002 |
| 2 | DNA | 0.5 | 0.5 ppm | 78.1 | 0.23 | | |
| 3 | DNA | 0.26 | — | 63.5 | 2.41 | 15.2 | 2.26E−05 |
| 4 | DNA | 0.26 | 0.5 ppm | 78.6 | 1.12 | | |
| 5 | DNA | 0 | — | 76.7 | 0.72 | 3.8 | 5.8E−05 |
| 6 | DNA | 0 | 0.5 ppm | 80.5 | 0.82 | | |
| 1 | Tracer | 0.5 | — | 73.6 | 1.81 | 5.2 | 0.002 |
| 2 | Tracer | 0.5 | 0.5 ppm | 78.8 | 0.67 | | |
| 3 | Tracer | 0.26 | — | 72.5 | 0.91 | 6.6 | 2.06E−06 |
| 4 | Tracer | 0.26 | 0.5 ppm | 79.1 | 0.77 | | |
| 5 | Tracer | 0 | — | 76.0 | 0.77 | 2.4 | 0.017 |
| 6 | Tracer | 0 | 0.5 ppm | 78.4 | 1.44 | | |
| — | Un-washed | — | — | 89.2 | 0.28 | — | — |

*Except in the first wash cycle where the DNA concentration of the DNA swatches was 1.0 mg/mL for beaker 1 and 2, and 0.5 for beaker 3 and 4.
(**) Delta Y-values are calculated as "$\text{Average}_{with\ DNase} - \text{Average}_{without\ DNase}$", the higher the delta Y value the better the DNase whiteness effect during wash
(***) T-test values of <0.05 indicates that the two averages are statistically significantly different from each other on at least a 5% significance level After 4 wash cycles with dirty detergent the following results were observed. For DNA swatches was observed a statistically significant whiteness effect of having 0.5 ppm DNase in wash. Adding DNase to the detergent solution decreased the amount of DNA on the swatches and decreased the amount of dirt that attached to the DNA swatches during wash and thus increased the whiteness of the DNA swatches after wash compared to wash with no DNase. For all tracer swatches in all beakers there was a statistically significant antiredeposition effect of washing with 0.5 ppm DNase. Adding DNase to the detergent solution resulted in decreased transfer of DNA from DNA swatches to tracer swatches during wash, decreased the amount of dirt that attached to the tracer swatches during wash and thus increased the whiteness of the tracers after wash compared to wash with no DNase.

Example 5

Example 5a: Assay

Sensory Analysis of E-2-Nonenal on Textile

One way of testing for the presence of malodor on textiles is by using E-2-Nonenal as a marker for the malodor, as this compound contributes to the malodor on laundry.

Add a solution of E-2-nonenal to 5 cm×5 cm textile swatches and place the swatches in 50 mL Falcon tubes with a screw cap. Use one or more persons with a normal sense and sensitive to E-2-Nonenal in different concentrations of smell to evaluate the odor intensity of each tube by smelling the tubes with a reasonable time between the tubes to avoid nasal fatigue. Use new sets of tubes for each person evaluating the odor intensity. The odor intensity can be scored on a scale of 1 to 8, where 1 is no odor and 8 is very strong odour.

Example 5b

Sensory Analysis of E-2-Nonenal on a DNA Swatch Washed with and without DNase

This example shows that adding a DNase in wash can reduce the malodor in laundry by reducing the odor intensity of odorous compounds like E-2-Nonenal.

5 cm×5 cm autoclaved cotton textile (wfk10A) swatches were placed in separate petri dishes, and 500 μL of MilliQ water was applied to 2 swatches, 500 μL of a solution of 0.1 mg/mL DNA from salmon testes dissolved in MilliQ water was applied to 2 swatches and 500 μL of a solution of 1.0 mg/mL DNA from salmon testes dissolved in MilliQ water was applied to 2 swatches. The 6 swatches were left to dry overnight at room temperature.

400 μL of 10 mM E-2-Nonenal dissolved in MilliQ water was applied to all of the 6 dry swatches, and they were left to dry for 1 hour under maximum flow in a LAF bench. The dry swatches were then placed in each of six 50 mL Falcon tubes together with each 20 mL of wash liquor made from MilliQ water and a liquid detergent (Model detergent A from example 1) in a concentration of 3.33 g/L and 30 ppm of DNase (NucB from *B. subtilis*) was added to beaker (tube) number 2, 4 and 6 and mixed thoroughly all as described in Table ?.

The beakers were closed with a lid and mounted in a Mini-Laundr-O-Meter (a Stuart Tube Rotator SB3); the swatches were then washed at 30° C. for 60 minutes at 40 rpm.

After wash, the wash liquor was discarded and the swatches were rinsed 2 times with 15 mL MilliQ water and left in the beakers with the lid closed. The beakers containing the wet textile were then evaluated in a random order for odor intensity by a blindfolded person with a normal sense of smell and sensitive to E-2-Nonenal. The results are noted Table 7 below:

| Beaker | mg/mL DNA swatch | E-2-nonenal (400 μL of 10 mM) | DNase in wash | Odor intensity |
|---|---|---|---|---|
| 1 | 0.0 | + | — | 4.5 |
| 2 | 0.0 | + | 30 ppm | 6.5 |
| 3 | 0.1 | + | — | 7.5 |
| 4 | 0.1 | + | 30 ppm | 5 |
| 5 | 1.0 | + | — | 7 |
| 6 | 1.0 | + | 30 ppm | 3 |

*Odor Intensity on a scale of 1 to 8, where 1 is no odor and 8 is very strong odour.

The results in Table 7 show that adding DNase to the wash can decrease the odor intensity of E-2-Nonenal sticking to the DNA swatches after wash thereby decreasing the malodor on textile after wash.

SEQUENCE LISTING

<160> NUMBER OF SEQ ID NOS: 2

<210> SEQ ID NO 1
<211> LENGTH: 136
<212> TYPE: PRT
<213> ORGANISM: Bacillus subtilis
<220> FEATURE:
<221> NAME/KEY: SIGNAL
<222> LOCATION: (1)..(26)
<220> FEATURE:
<221> NAME/KEY: mat_peptide
<222> LOCATION: (27)..(136)

<400> SEQUENCE: 1

Met Lys Lys Trp Met Ala Gly Leu Phe Leu Ala Ala Ala Val Leu Leu
    -25  -20  -15

Cys Leu Met Val Pro Gln Gln Ile Gln Gly Ala Ser Ser Tyr Asp Lys
-10  -5  -1  1  5

Val Leu Tyr Phe Pro Leu Ser Arg Tyr Pro Glu Thr Gly Ser His Ile
        10  15  20

Arg Asp Ala Ile Ala Glu Gly His Pro Asp Ile Cys Thr Ile Asp Arg
    25  30  35

Asp Gly Ala Asp Lys Arg Arg Glu Glu Ser Leu Lys Gly Ile Pro Thr
    40  45  50

Lys Pro Gly Tyr Asp Arg Asp Glu Trp Pro Met Ala Val Cys Glu Glu
55  60  65  70

Gly Gly Ala Gly Ala Asp Val Arg Tyr Val Thr Pro Ser Asp Asn Arg
        75  80  85

Gly Ala Gly Ser Trp Val Gly Asn Gln Met Ser Ser Tyr Pro Asp Gly
        90  95  100

Thr Arg Val Leu Phe Ile Val Gln
    105  110

<210> SEQ ID NO 2
<211> LENGTH: 142
<212> TYPE: PRT
<213> ORGANISM: Bacillus licheniformis
<220> FEATURE:
<221> NAME/KEY: SIGNAL
<222> LOCATION: (1)..(33)
<220> FEATURE:
<221> NAME/KEY: mat_peptide
<222> LOCATION: (34)..(142)

<400> SEQUENCE: 2

Met Ile Lys Lys Trp Ala Val His Leu Leu Phe Ser Ala Leu Val Leu
        -30  -25  -20

Leu Gly Leu Ser Gly Gly Ala Ala Tyr Ser Pro Gln His Ala Glu Gly
    -15  -10  -5

Ala Ala Arg Tyr Asp Asp Ile Leu Tyr Phe Pro Ala Ser Arg Tyr Pro
-1  1  5  10  15

Glu Thr Gly Ala His Ile Ser Asp Ala Ile Lys Ala Gly His Ser Asp
        20  25  30

Val Cys Thr Ile Glu Arg Ser Gly Ala Asp Lys Arg Arg Gln Glu Ser
        35  40  45

Leu Lys Gly Ile Pro Thr Lys Pro Gly Phe Asp Arg Asp Glu Trp Pro
    50  55  60

Met Ala Met Cys Glu Glu Gly Gly Lys Gly Ala Ser Val Arg Tyr Val
    65  70  75

Ser Ser Ser Asp Asn Arg Gly Ala Gly Ser Trp Val Gly Asn Arg Leu

-continued

```
80                  85                  90                  95

Ser Gly Phe Ala Asp Gly Thr Arg Ile Leu Phe Ile Val Gln
                100                 105
```

The invention claimed is:

1. A detergent composition comprising (a) one or more anionic surfactants;

(b) an enzyme selected from the group consisting of: a protease, a cutinase, a carbohydrase, a cellulase, a pectinase, a mannanase, an arabinase, a galactanase, a xylanase, and an oxidase; and (c) a deoxyribonuclease (DNase), the detergent composition not including an amylase and not including a lipase, and the detergent composition removing from a textile or preventing from sticking to a textile, malodorous compounds or dirt (pigment soil) that are on or may be on the textile, in the presence of DNA, better than the same detergent composition that lacks the DNase, wherein the detergent composition comprises 10-40 w/w % of the surfactants, 4-50 w/w % of a builder and 0-5 w/w % of a polymer and optionally a filler, solvents and an enzyme stabilizer.

2. The composition of claim 1, wherein the DNase is obtainable from *Bacillus*.

3. The composition of claim 1, wherein the detergent composition is capable of reducing adhesion of bacteria selected from the group consisting of *Acinetobacter*sp., *Aeromicrobium* sp., *Brevundimonas* sp., *Microbacterium* sp., *Micrococcus luteus, Pseudomonas* sp., *Staphylococcus epidermidis*, and *Stenotrophomonas* sp. to a surface, or releasing the bacteria from a surface to which they adhere.

4. The composition of claim 1, wherein the composition is capable of reducing malodor from wet or dry laundry, the malodor determined by sensory analysis.

5. The composition of claim 1, wherein the composition is capable of reducing E-2-nonenal from wet or dry laundry.

6. A washing method for a textile comprising:

(a) exposing the textile to a wash liquor comprising the detergent composition of claim 1, and (b) completing at least one wash cycle.

7. The method of claim 6, further comprising rinsing the textile.

8. The method of claim 6, wherein the temperature of the wash liquor is in the range of 5° C. to 95° C.

9. The method of claim 6, wherein whiteness of the textile is maintained or improved by the washing method.

10. The method of claim 6, wherein redeposition of soil released during the wash cycle, on the textile, is reduced by the washing method.

11. A detergent composition for washing a textile with malodorous compounds or dirt (pigment soil) on the textile, in the presence of DNA on the textile, comprising:

(a) an anionic surfactant;

(b) a protease, cutinase, carbohydrase, cellulose, pectinase, mannanase, arabinose, galactanase, xylanase or an oxidase, but not an amylase and not a lipase; and (c) a dexoyribonuclease (DNase), that when contacted with the textile, the detergent composition removes and prevents from sticking to the textile, the malodorous compounds or dirt, better than the same detergent that lacks the DNase, wherein the detergent composition comprises 10-40 w/w % of the surfactant, 4-50 w/w % of a builder and 0-5 w/w % of a polymer and optionally a filler, solvents and an enzyme stabilizer.

* * * * *